US010907297B2

(12) United States Patent
Kohavi et al.

(10) Patent No.: US 10,907,297 B2
(45) Date of Patent: Feb. 2, 2021

(54) CLOSED CYCLE CONDENSER DRYER WITH HEAT REGENERATION

(71) Applicant: WATERGEN Ltd., Petah Tikva (IL)

(72) Inventors: Arye Kohavi, Newe Monosson (IL); Sharon Dulberg, Beer Sheva (IL)

(73) Assignee: WATERGEN LTD., Petach Tikva (IL)

( * ) Notice: Subject to any disclaimer, the term of this patent is extended or adjusted under 35 U.S.C. 154(b) by 0 days.

(21) Appl. No.: 15/987,921

(22) Filed: May 24, 2018

(65) Prior Publication Data

US 2018/0283803 A1 Oct. 4, 2018

Related U.S. Application Data

(60) Division of application No. 14/594,186, filed on Jan. 12, 2015, now Pat. No. 10,006,721, which is a (Continued)

(51) Int. Cl.
*F26B 21/06* (2006.01)
*D06F 58/24* (2006.01)
(Continued)

(52) U.S. Cl.
CPC ..... *D06F 58/24* (2013.01); *D06F 58/26* (2013.01); *F24F 3/1405* (2013.01);
(Continued)

(58) Field of Classification Search
CPC .... F28F 3/086; F28F 1/32; F28F 9/001; F28F 9/0275; F28F 9/0265; F28F 17/005;
(Continued)

(56) References Cited

U.S. PATENT DOCUMENTS 2,154,481 A 4/1939 Vorkauf
3,509,639 A 5/1970 Fritz
(Continued)

FOREIGN PATENT DOCUMENTS

CN 101187486 5/2008
CN 201569092 9/2010
(Continued)

OTHER PUBLICATIONS

Palandre et al., "Comparison of Heat Pump Dryer and Mechanical Steam Compression Dryer", International Congress of Refrigeration, 8 pages, year 2003.
(Continued)

*Primary Examiner* — John P McCormack
(74) *Attorney, Agent, or Firm* — Pearl Cohen Zedek Latzer Baratz LLP

(57) ABSTRACT

A drying apparatus includes a compartment for containing objects to be dried, a closed-loop air pathway and a regeneration heat exchanger. The closed-loop air pathway includes a cooling element and a heating element, and is configured to extract from the compartment air that includes moisture in the form of vapor, to evacuate heat energy from the extracted air to an external fluid flow by cooling using the cooling element so as to remove at least some of the moisture from the air, to reheat the air using the heating element, and to re-introduce the reheated air into the compartment. The regeneration heat exchanger is inserted in the closed-loop air pathway and is configured to transfer heat from the air extracted from the compartment to the air exiting the cooling element in the closed-loop air pathway.

18 Claims, 17 Drawing Sheets

Related U.S. Application Data continuation-in-part of application No. PCT/IB2014/059620, filed on Mar. 11, 2014, which is a continuation of application No. 13/834,857, filed on Mar. 15, 2013, now Pat. No. 9,140,396.

(51) Int. Cl.

| | |
|---|---|
| ***F24F 3/14*** | (2006.01) |
| ***F28D 1/047*** | (2006.01) |
| ***F28F 1/32*** | (2006.01) |
| ***F28F 9/00*** | (2006.01) |
| ***F28D 1/04*** | (2006.01) |
| ***F28F 9/02*** | (2006.01) |
| ***F28D 7/08*** | (2006.01) |
| ***F28D 9/00*** | (2006.01) |
| ***F28F 17/00*** | (2006.01) |
| ***D06F 58/26*** | (2006.01) |
| ***F28F 3/08*** | (2006.01) |
| *F28D 21/00* | (2006.01) |

(52) U.S. Cl.

CPC ..... *F28D 1/0426* (2013.01); *F28D 1/0461* (2013.01); *F28D 1/0477* (2013.01); *F28D 7/08* (2013.01); *F28D 7/085* (2013.01); *F28D 9/0062* (2013.01); *F28D 9/0068* (2013.01); *F28F 1/32* (2013.01); *F28F 3/086* (2013.01); *F28F 9/001* (2013.01); *F28F 9/0265* (2013.01); *F28F 9/0275* (2013.01); *F28F 17/005* (2013.01); *F28D 2021/0038* (2013.01); *Y10T 137/6579* (2015.04)

(58) Field of Classification Search

CPC .... F28D 1/0477; F28D 1/0461; F28D 1/0426; F28D 7/08; F28D 7/085; F28D 9/0062; F28D 9/0068; F28D 2021/0038; D06F 58/24; D06F 58/26; F24F 3/1405; F16L 53/00; Y10T 137/6579

USPC ..... 34/73–79, 428, 427, 86

See application file for complete search history.

(56) References Cited

U.S. PATENT DOCUMENTS

| | | | | |
|---|---|---|---|---|
| 4,154,003 | A | 5/1979 | Muller | |
| 4,326,344 | A | 4/1982 | Smith | |
| 4,447,965 | A | 5/1984 | Bray | |
| 4,475,589 | A | 10/1984 | Mizuno et al. | |
| 4,609,039 | A | 9/1986 | Fushiki et al. | |
| 4,742,866 | A | 5/1988 | Izumida et al. | |
| 5,228,211 | A | 7/1993 | Stubbing | |
| 5,478,544 | A | 12/1995 | Schutte et al. | |
| 5,611,209 | A | 3/1997 | Ogasawara et al. | |
| 5,636,449 | A | 6/1997 | Gaddis et al. | |
| 6,112,426 | A | 9/2000 | Buttazzi | |
| 6,161,306 | A | 12/2000 | Clodic | |
| 6,427,454 | B1 | 8/2002 | West | |
| 6,478,855 | B1 | 11/2002 | Okano | |
| 6,585,871 | B1 | 7/2003 | Anzaki et al. | |
| 6,829,900 | B2 | 12/2004 | Urch | |
| 6,895,774 | B1 | 5/2005 | Ares et al. | |
| 6,904,703 | B2 | 6/2005 | Naganawa et al. | |
| 6,944,969 | B2 | 9/2005 | Clodic et al. | |
| 6,945,065 | B2 | 9/2005 | Lee et al. | |
| 6,973,795 | B1 | 12/2005 | Moffitt | |
| 7,007,495 | B2 | 3/2006 | Lee et al. | |
| 7,096,684 | B2 | 8/2006 | Yabu et al. | |
| 7,121,102 | B2 | 10/2006 | Fijas et al. | |
| 7,150,160 | B2 | 12/2006 | Herbert | |
| 7,191,604 | B1 | 3/2007 | Wiggs | |
| 7,201,013 | B2 | 4/2007 | Yabu | |
| 7,281,389 | B1 | 10/2007 | O'Brien et al. | |
| 7,290,595 | B2 | 11/2007 | Kawai et al. | |
| 7,337,615 | B2 | 3/2008 | Reidy | |
| 7,448,224 | B2 | 11/2008 | Wu et al. | |
| 7,469,486 | B2 * | 12/2008 | Tamura | D06F 58/02 34/474 |
| 7,526,879 | B2 * | 5/2009 | Bae | D06F 58/206 34/239 |
| 7,540,166 | B2 | 6/2009 | O'Brien et al. | |
| 7,581,408 | B2 * | 9/2009 | Stark | F24F 3/153 62/93 |
| 8,015,832 | B2 | 9/2011 | Setoguchi et al. | |
| 8,240,064 | B2 | 8/2012 | Steffens | |
| 8,316,660 | B2 | 11/2012 | Demonte et al. | |
| 8,353,115 | B2 | 1/2013 | Steffens | |
| 8,438,751 | B2 | 5/2013 | Stolze | |
| 8,453,720 | B2 * | 6/2013 | Song | F28D 9/0062 165/111 |
| 8,572,862 | B2 | 11/2013 | Tegrotenhuis | |
| 8,590,606 | B2 | 11/2013 | Arai et al. | |
| 8,650,770 | B1 | 2/2014 | Levy | |
| 8,769,971 | B2 | 7/2014 | Kozubal et al. | |
| 9,689,626 | B2 | 6/2017 | Van Heeswijk et al. | |
| 2002/0116935 | A1 | 8/2002 | Forkosh et al. | |
| 2003/0075222 | A1 | 4/2003 | Smith, IV et al. | |
| 2004/0107723 | A1 | 6/2004 | Lee et al. | |
| 2004/0250557 | A1 | 12/2004 | Yabu et al. | |
| 2005/0081576 | A1 | 4/2005 | Park et al. | |
| 2006/0168842 | A1 | 8/2006 | Sprague | |
| 2007/0079619 | A1 | 4/2007 | Hamada et al. | |
| 2007/0266726 | A1 | 11/2007 | Tada et al. | |
| 2008/0006039 | A1 | 1/2008 | Kim et al. | |
| 2008/0083230 | A1 | 4/2008 | Giallombardo | |
| 2008/0189973 | A1 | 8/2008 | Dittmer et al. | |
| 2008/0223050 | A1 | 9/2008 | Bruders et al. | |
| 2008/0235977 | A1 | 10/2008 | Kuwabara | |
| 2009/0205354 | A1 | 8/2009 | Brown | |
| 2009/0314480 | A1 | 12/2009 | Grinbergs et al. | |
| 2010/0132930 | A1 | 6/2010 | Izenson et al. | |
| 2010/0181055 | A1 | 7/2010 | Yamada | |
| 2010/0212334 | A1 | 8/2010 | Demonte et al. | |
| 2010/0212335 | A1 | 8/2010 | Lukitobudi | |
| 2010/0257878 | A1 | 10/2010 | Arbel et al. | |
| 2010/0275621 | A1 | 11/2010 | Oliveira, Jr. | |
| 2010/0294458 | A1 | 11/2010 | Murayama et al. | |
| 2011/0000099 | A1 * | 1/2011 | Steffens | D06F 58/206 34/493 |
| 2012/0030959 | A1 | 2/2012 | Yang | |
| 2012/0107663 | A1 | 5/2012 | Burgers et al. | |
| 2012/0210597 | A1 * | 8/2012 | Bison | D06F 58/206 34/524 |
| 2012/0233876 | A1 | 9/2012 | Weldon et al. | |
| 2013/0047662 | A1 | 2/2013 | Black et al. | |
| 2013/0167584 | A1 | 7/2013 | Gershtein et al. | |
| 2014/0082960 | A1 | 3/2014 | Bison et al. | |
| 2014/0261764 | A1 | 9/2014 | Kohavi et al. | |

FOREIGN PATENT DOCUMENTS

| | | |
|---|---|---|
| DE | 3446468 | 7/1986 |
| DE | 199 13 938 | 9/2000 |
| DE | 202 02 782 | 4/2002 |
| DE | 10 2007 016077 | 10/2008 |
| DE | 10 2008 004459 | 7/2009 |
| DE | 10 2008 043176 | 4/2010 |
| EP | 0 467 188 | 1/1992 |
| EP | 0861403 | 9/1996 |
| EP | 1 443 281 | 8/2004 |
| EP | 2 267 207 | 12/2010 |
| EP | 2511636 | 10/2012 |
| EP | 2576888 | 3/2014 |
| EP | 2576889 | 4/2014 |
| FR | 2515805 | 5/1983 |
| GB | 570 541 | 7/1945 |
| GB | 938088 | 3/1961 |
| GB | 2 375 812 | 11/2002 |
| JP | S56132471 | 10/1981 |
| JP | S58117941 | 7/1983 |
| JP | 2001263729 | 9/2001 |

(56) References Cited

FOREIGN PATENT DOCUMENTS

| | | |
|---|---|---|
| WO | WO 2000/026595 | 5/2000 |
| WO | WO 2010/118965 | 10/2010 |
| WO | WO 2013/000955 | 1/2013 |
| WO | WO 2014/141059 | 9/2014 |
| WO | WO 2015/136393 | 9/2015 |

OTHER PUBLICATIONS

International Application # PCT/IB2014/059620 Search Report dated Jul. 1, 2014.
European Search Report of Application No. EP15760660.9 dated Nov. 17, 2017.
European Search Report of Application No. 16200585 dated Apr. 24, 2017.
International Search Report of Application No. PCT/IB2015/050984 dated Jun. 14, 2015.
Office Action of U.S. Appl. No. 14/594,186 dated Feb. 24, 2017.
Office Action of Chinese Application No. 201480016055X dated May 30, 2016.
Office Action of U.S. Appl. No. 14/859,910, dated Jan. 18, 2017.
Supplementary European Search Report of Application No. EP14765084.0 dated Mar. 31, 2016.
Supplementary Search Report of Application No. EP 14 76 5084 dated Mar. 31, 2016.

* cited by examiner

CLOSED CYCLE CONDENSER DRYER WITH HEAT REGENERATION

CROSS-REFERENCE TO RELATED APPLICATIONS

This application is a divisional of U.S. patent application Ser. No. 14/594,186, filed Jan. 12, 2015, which is a continuation-in-part of International Patent Application No. PCT/IB2014/059620, filed Mar. 11, 2014, which claims priority from U.S. patent application Ser. No. 13/834,857, filed Mar. 15, 2013, all of which are incorporated herein by reference.

FIELD OF THE INVENTION

The present invention relates generally to laundry dryers and other drying apparatuses, and particularly to closed-cycle condenser dryers.

BACKGROUND OF THE INVENTION

Various drying techniques are known in the art. Example techniques include exhaust pipe techniques, condenser-based techniques, heat-exchanger-based techniques and techniques based on heat pumps. Such techniques are implemented, for example, in laundry dryers. The various drying techniques differ from one another in parameters such as cost and energy efficiency.

For example, U.S. Pat. No. 8,438,751, whose disclosure is incorporated herein by reference, describes a dryer having a drying chamber for items to be dried and a process air duct in which are located a heater for heating the process air, a blower for driving the process air from the heater through the drying chamber, and a heat exchanger arrangement. Via the heat exchanger arrangement, heat can be withdrawn from the process air flowing away from the drying chamber, and the process air flowing toward the heater can be fed to the heat exchanger.

U.S. Pat. No. 8,240,064, whose disclosure is incorporated herein by reference, describes a dryer that includes a drying chamber for articles to be dried, a supply air duct, a process air duct, a heater in the process air duct for heating process air, a blower that guides the heated process air over the articles to be dried, an exhaust air duct that directs exhaust air to an exhaust air outlet, and an internally and/or externally cleanable lint filter in a recirculated air duct that splits at a branching-off point from the process air duct to the heater and the exhaust air duct which leads to the exhaust air outlet. The recirculated air duct joins the supply air duct upstream of the heater.

U.S. Pat. No. 8,353,115, whose disclosure is incorporated herein by reference, describes an exhaust air dryer that includes a process airflow entering from outside as supply air, which removes moisture from laundry introduced in a treatment compartment and which emerges to the outside as exhaust air through an air outlet, a heat exchanger between the treatment compartment and the air outlet, and an active heat pump seen in the airflow direction, which removes heat from the process airflow, while forming condensate, and at the same time heats the incoming air.

U.S. Patent Application Publication No. 2012/0030959, whose disclosure is incorporated herein by reference, describes a rotary drum dryer with heat recycling and water collecting function. The dryer dries rolling clothes by electric heating thermal energy. A heat exchanging unit with heat recycling function is further installed between the room temperature air flow and the discharged hot air, for preheating the intake air flow by the thermal energy of the discharged hot air through the heat exchanging unit. Moisture is converted into a liquid state via a cooling effect generated through heat exchanging between water-contained hot air and colder air and is collected.

U.S. Pat. No. 8,572,862, whose disclosure is incorporated herein by reference, describes a drying apparatus that includes a drum and an open-loop airflow pathway originating at an ambient air inlet, passing through the drum, and terminating at an exhaust outlet. A passive heat exchanger is included for passively transferring heat from air flowing from the drum toward the exhaust outlet to air flowing from the ambient air inlet toward the drum. A heat pump is also included for actively transferring heat from air flowing from the passive heat exchanger toward the exhaust outlet to air flowing from the passive heat exchanger toward the drum. A heating element is also included for further heating air flowing from the heat pump toward the drum.

U.S. Patent Application Publication No. 2012/0233876, whose disclosure is incorporated herein by reference, describes a home laundry dryer in which both the fresh air entering a laundry drum and the air exhausted from the drum pass through thermal recovery ducting. The dryer heat recovery system has concentric ducting including a high temperature passage through which the exhaust air flows and a separate low temperature passage through which the entering air flows. Heat from the exhausted air is transferred from the high temperature passage to the entering air in the low temperature passage. This heat transfer lowers the energy required to raise the entering air to a desired drying temperature. The dryer ducting is designed to have an outer diameter equivalent to standard size ducting on home dryers.

European Patents Nos. EP 2576889 and EP 2576888, whose disclosures are incorporated herein by reference, describe thermoelectric heat pump laundry dryers. U.S. Pat. No. 7,526,879, whose disclosure is incorporated herein by reference, describes a drum washing machine and a clothes dryer equipped with a thermoelectric module. The thermoelectric module includes a heat absorption side and a heat dissipation side. The heat absorption side is disposed at a hot air flowing passage.

U.S. Pat. No. 4,154,003, whose disclosure is incorporated herein by reference, describes a combination washer-dryer comprised of an inner and outer container that are spaced apart so as to form a condensation chamber therebetween. A cooling medium and moist air withdrawn from the inner drying container are simultaneously forced through that chamber which cools the air and causes moisture contained therein to be condensed and thus separatable from the air. Additional condensation and water separators can be employed to further treat the circulating air prior to that air being reheated and returned to the inner drying container.

SUMMARY OF THE INVENTION

An embodiment of the present invention that is described herein provides a drying apparatus including a compartment for containing objects to be dried, a closed-loop air pathway and a regeneration heat exchanger. The closed-loop air pathway includes a cooling element and a heating element, and is configured to extract from the compartment air that includes moisture in the form of vapor, to evacuate heat energy from the extracted air to an external fluid flow by cooling using the cooling element so as to remove at least some of the moisture from the air, to reheat the air using the heating element, and to re-introduce the reheated air into the compartment. The regeneration heat exchanger is inserted in the closed-loop air pathway and is configured to transfer heat from the air extracted from the compartment to the air exiting the cooling element in the closed-loop air pathway.

In some embodiments, at least one of the regeneration heat exchanger and the cooling element is fabricated at least partially from a material having low thermal-conductivity. In some embodiments, at least one of the regeneration heat exchanger and the cooling element is fabricated at least partially from plastic. In an embodiment, the regeneration heat exchanger and the cooling element are fabricated jointly in a single mechanical assembly.

In an embodiment, by transferring the heat, the regeneration heat exchanger is configured to cool and optionally condensate the air extracted from the compartment, and to heat the air exiting the cooling element. In a disclosed embodiment, the cooling element includes a cooling heat exchanger that is configured to cool the extracted air by heat exchange with the external fluid flow.

In some embodiments, the heating element is configured to heat the air before re-introduction into the compartment at least partially by transferring heat from another fluid flow. The other fluid flow may include the air in the closed-loop pathway prior to the cooling element. Alternatively, the other fluid flow may include an external fluid flow exiting the cooling element.

In another embodiment, the cooling element is configured to cool the air at least partially by transferring heat to another fluid flow. In yet another embodiment, the cooling element includes a cooled core that is mounted inside the regeneration heat exchanger, the core is configured to cool the air flowing through the regeneration heat exchanger, and the regeneration heat exchanger is configured to cool the extracted air upstream of the core by transferring heat to the cooled air downstream of the core, and to heat the extracted air downstream of the core using heat of the extracted air upstream of the core.

In some embodiments, the drying apparatus includes a restrictor for allowing volumetric expansion or contraction of the closed-loop air pathway. In an embodiment, one side of the restrictor is connected to a location of driest and coolest air in the closed-loop pathway. In another embodiment, one side of the restrictor is connected to the external fluid flow heated by the cooling element. In yet another embodiment, an enclosure packages the drying apparatus and is arranged to emit and absorb external air, and one side of the restrictor is configured to exchange air with the inner side of the enclosure.

In a disclosed embodiment, the cooling element is configured to convert at least some of the heat energy evacuated from the air of the closed-loop pathway into electricity. In an example embodiment, the drying apparatus includes an external fluid pathway, which is configured to exploit at least some of the heat energy added in the drying apparatus to the external fluid, by circulating the external fluid via an external system. In another example embodiment, the drying apparatus includes a fluid pathway, which is configured to exploit at least some of the heat energy emitted from the closed-loop air pathway by storing the heat energy in one or more heat reservoirs. The heat reservoirs may include at least one of a fluid, a Phase Changing Material (PCM) and a material that stores the heat energy by reacting chemically.

There is additionally provided, in accordance with an embodiment of the present invention, a drying apparatus including at least first and second compartments for containing objects to be dried, and a closed-loop air pathway. The closed-loop air pathway is configured to cycle air in cascade through at least the first and second compartments, to extract air from the first compartment, to dry and reheat the air extracted from the first compartment, and to introduce the dried and reheated air into the second compartment.

In some embodiments, the drying apparatus includes a regeneration heat exchanger that is inserted in the closed-loop air pathway and is configured to dry and reheat the air extracted from the first compartment using heat of the air extracted from the second compartment. In some embodiments, the drying apparatus includes a second regeneration heat exchanger that is inserted in the closed-loop air pathway and is configured to dry and reheat the air entering the first compartment using heat of the air cooled in the regeneration heat exchanger.

In another embodiment, the drying apparatus includes a regeneration heat exchanger that is inserted in the closed-loop air pathway and is configured to dry and reheat the air entering the first compartment using heat of the air extracted from the second compartment. In yet another embodiment, the drying apparatus includes a heating element, which is inserted in the closed-loop air pathway and is configured to heat the air prior to entry to the second compartment. In still another embodiment, the drying apparatus includes a cooling element, which is inserted in the closed-loop air pathway and is configured to remove moisture from the air of the closed-loop air pathway by evacuating heat from the air after extraction from the second compartment and before entering the first compartment.

There is further provided, in accordance with an embodiment of the present invention, a drying method including, using a closed-loop air pathway, extracting air that includes moisture in the form of vapor from a compartment containing objects to be dried, evacuating heat energy from the extracted air to an external fluid flow by cooling using a cooling element so as to remove at least part of the moisture from the air, reheating the air using a heating element, and re-introducing the reheated air into the compartment. A heat exchanger inserted in the closed-loop air pathway is used for exchanging heat between the air extracted from the compartment and the air exiting the cooling element prior to reheating.

There is further provided, in accordance with an embodiment of the present invention, a drying method including cycling air using a closed-loop air pathway in cascade through at least first and second compartments containing objects to be dried. Air is extracted from the first compartment. The air extracted from the first compartment is dried, reheated and introduced into the second compartment.

The present invention will be more fully understood from the following detailed description of the embodiments thereof, taken together with the drawings in which:

DETAILED DESCRIPTION OF THE INVENTION EMBODIMENTS

Figure 1:
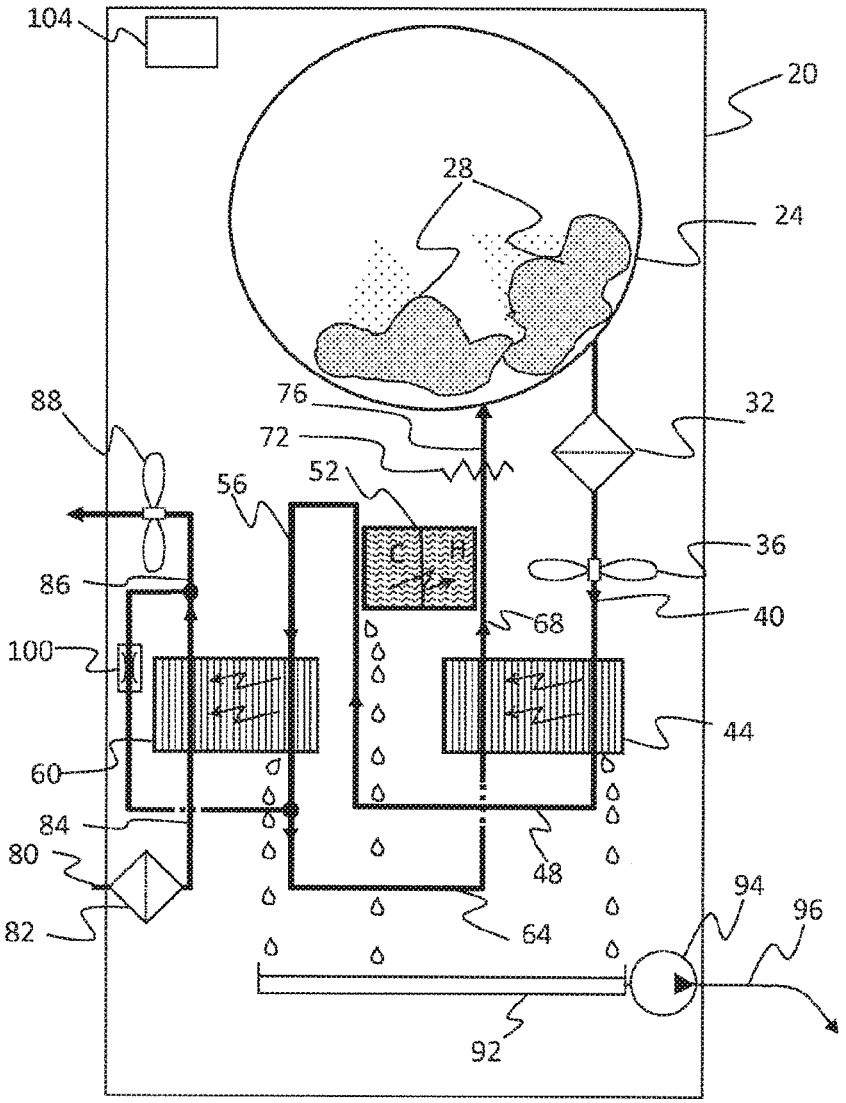
FIGS. 1 and 2 are block diagrams that schematically illustrate closed-cycle condenser-based laundry dryers, in accordance with embodiments of the present invention.

Embodiments of the present invention that are described herein provide improved methods and systems for drying. The embodiments described herein refer mainly to laundry dryers, but the disclosed techniques can be used in various other suitable applications that involve drying.

In some embodiments, a dryer comprises a compartment containing objects to be dried, e.g., a drum for holding laundry to be dried. A closed-loop pathway extracts from the compartment air that includes moisture in the form of vapor. The closed-loop pathway cools the extracted air using a cooling element. The cooling operation causes at least part of the moisture to condensate, and thus dries the extracted air. The closed-loop pathway then reheats the cool and dry air using a heating element, and re-introduces the reheated air into the compartment.

In order to improve the energy efficiency of the dryer, a regeneration heat exchanger is inserted in the closed-loop air pathway. The regeneration heat exchanger exchanges heat between the air extracted from the compartment and the air cooled by the cooling element prior to reheating: The air extracted from the compartment cools and condensates by the air that exits the cooling element, and the air that exits the cooling element is heated by the air extracted from the compartment.

By performing the above-described heat exchange operation inside the closed-loop air pathway, a considerable portion of heat energy, which has been removed from the air and from the condensing water vapor, is reused and fed-back into the compartment. Consequently, the energy efficiency of the dryer improves considerably, e.g., by a factor of 10-20%.

The disclosed solution can be viewed as a closed-loop scheme having two heat exchange operations—one as a cooling element, and one as a regeneration heat exchanger. In the present context, the term "regeneration heat exchanger inserted in the closed-loop pathway" means that the heat exchanger performs regeneration heat exchanging between the air at two different locations along the closed-loop pathway having different thermodynamic states—the air extracted from the compartment, and the air cooled by the cooling element.

Several example implementations of this scheme are described herein. In some embodiments, the cooling element comprises an additional heat exchanger that exchanges heat with external air. In other embodiments, the cooling element and the heating element are part of a heat pump. In yet other embodiments, the cooling element comprises a cooled core that is mounted inside the heat exchanger. Dehumidification aspects of using a heat exchanger having a cooled core are addressed in U.S. Patent Application Publication No. 2014/0261764 and PCT International Patent Application Publication No. WO 2014/141059, whose disclosures are incorporated herein by reference.

In some embodiments, the regeneration heat exchanger and/or the cooling element are fabricated from a material having low thermal conductivity, such as plastic. In an example embodiment, the regeneration heat exchanger and the cooling element are fabricated in a single mechanical assembly, e.g., using one or more duplication of similar plastic leaves.

In other embodiments that are described herein, the air re-entering the compartment is heated by a Thermo-Electric Cooler (TEC). In some of these embodiments, the cold side of the TEC is in contact with the humid air prior to entering the cooling element. In alternative embodiments, the cold side of the TEC is in contact with the external air prior to exiting the dryer. In some embodiments, a heat pump may replace the TEC functionality, and vice versa.

In other disclosed embodiments, a dryer comprises multiple compartments, e.g., for drying multiple different types of laundry. The closed-loop pathway traverses the multiple compartments in cascade. Each compartment is coupled to a respective heat exchanger, which exchanges heat between the air entering the compartment and the air removed from the last compartment in the cascade. By reusing heat in multiple stages in this manner, considerably high efficiency can be achieved.

In other embodiments, heat that is removed by the cooling element is reused for heating an external system, for example a washing machine or some central heating system. The removed heat may alternatively be stored and used later internally, e.g., in a subsequent drying cycle.

In yet other embodiments, the cooling element comprises a thermo-electric generator (TEG) or other heat generator, which converts some of the removed heat into electricity. The harvested electricity can be used internally in the dryer to further improve its efficiency, or exported to an external system.

Condenser-based Dryer with Regeneration Heat Exchanger and Cooling Heat Exchanger FIG. 1 is a block diagram that schematically illustrates a condenser-based laundry dryer 20, in accordance with an embodiment of the present invention. Dryer 20 comprises a compartment for holding objects to be dried, in the present example a drum 24 for holding laundry 28 to be dried. Drum 24 may be spinning, e.g., using an electrical motor. Alternatively, any other suitable type of compartment can be used.

Dryer 20 dries laundry 28 using a closed-loop air cycle, referred to herein as a closed-loop pathway. The term "closed-loop" means that air is extracted from drum 24, dehumidified and then re-introduced into the drum. In other words, a closed-loop drying cycle generally does not introduce air from outside the dryer into the drum and does not extract air from the drum to the outside of the dryer. (In some embodiments, a small quantity of air may be released from the closed loop or added to the closed loop, e.g., through a suitable restrictor or nozzle, whose function will be explained below. This mechanism is not regarded as violating the closed loop cycle. Moreover, air leakage to or from the closed-cycle elements, which is common in any practical closed-cycle implementation, is also not considered violating the closed loop cycle.)

In the example closed-loop pathway of FIG. 1, a blower 36 extracts hot and humid air 40 from drum 24 via a fiber filter 32. Air 40 passes through a regeneration heat exchanger 44, whose role is described in detail below. Air 48 exiting heat exchanger 44 is cooler and typically has higher relative humidity than air 40 entering the heat exchanger. Typically, condensation will occur in heat exchanger 44, as air 40 cools, saturates, and continues to be cooled, thus producing condensate water 92.

Air 48 exits heat exchanger 44, and may pass through the cold side of a Thermo-Electric Cooler (TEC) device 52. Typically, condensation will also occur at the cold side of the TEC device, as air 44 continues to be cooled, thus producing more condensate water 92. Air 48 exits the cold side of the TEC device as air 56 and continues toward a cooling element.

In the example of FIG. 1, the cooling element comprises a heat exchanger 60 (also referred to as a cooling heat exchanger) that cools air 48 by exchanging heat with external air 80. In the present example, the cold side of a TEC device is also part of the cooling element. External air 80 passes through a dust filter 82 to become filtered air 84, and enters heat exchanger 60 as the cooling media. Air 56 cools and condensates in heat exchanger 60, thus producing more condensate water 92, while external air 84 is being heated. Water 92 is typically being disposed of using a pump 94 and a drainage pipe 96.

Air 64 that exits heat exchanger 60 is typically slightly hotter than room temperature, saturated with humidity, but has low absolute humidity. Air 64 enters regeneration heat exchanger 44, and flows against the hot and humid air 40 that was extracted from drum 24. The heat exchange in regeneration heat exchanger 44 has two effects: Air 68 exits heat exchanger 44 is hotter and drier than air 64 enters the heat exchanger; and air 48 exits heat exchanger 44 is cooler and has higher relative humidity than air 40 enters the heat exchanger.

To conclude the closed-loop process, air 68 is further heated by a heating element, so as to produce hot and dry air 76, and air 76 is re-introduced into drum 24. In some embodiments, the heating element comprises an electrical heater 72. Additionally or alternatively, the heating element may comprise the hot side of TEC device 52. A blower 88 removes air 86 from heat exchanger 60 to the external environment.

Since heat energy is added to the closed-loop pathway (e.g., using the heating element, whether heater 72, TEC 52 or any other alternative or combination) the removed air 86 should be hotter than the ambient environment in order to dispose of the added energy. Note that humidity is not added to the removed air, and therefore the process will eventually condensate almost all of the water that was extracted from drum 24.

In some embodiments, a restrictor 100 (e.g., a nozzle) bridges between the location where the air is driest and coolest in the closed-loop pathway and between the hottest location in the external process. The restrictor enables small volumetric changes of air in the closed-loop cycle. For example, when the closed-loop air volume expands (e.g., due to heating and/or water evaporation), the excess cold and dry air can be released from the closed cycle via the restrictor toward the external process air. As another example, when the closed-loop air volume contracts (e.g., due to cooling and/or water condensation), hot air from the external process can be added to the closed loop via the restrictor, to compensate for the contracted volume.

In some embodiments, however, one side of the restrictor may be placed at any other suitable location in the closed-loop pathway, and the other side of the restrictor may be placed at any other suitable location in the external air process.

In an alternative embodiment, TEC 52 can be replaced by a heat pump. Such a heat pump typically uses a refrigerant cycle, which cycles a refrigerant via a refrigerant evaporator, a compressor, a refrigerant condenser and an expansion valve. The refrigerant evaporator functions as the cold side of TEC 52, and the refrigerant condenser functions as the hot side of TEC 52.

Generally, in all of the embodiments described herein, a TEC device may be replaced by a heat pump, and vice versa.

In some embodiments, a controller 104, e.g., a suitable microprocessor, controls and manages the operation of the dryer.

In some embodiments, heat exchanger 44 and/or heat exchanger 60 are fabricated from a material having low thermal conductivity, for example plastic or other non-metallic material. In some embodiments, the two heat exchangers in dryer 20 (heat exchanger 44 and cooling element 60) are fabricated in a single mechanical assembly. For example, heat exchangers 44 and 60 may have similar leaf structures, and may be fabricated in plastic using a single mold (with or without small variations).

In an alternative embodiment, the functionality of heat exchanger 44 can be included in TEC device 52, and the two elements may be united and implemented in a single component.

Figure 2:
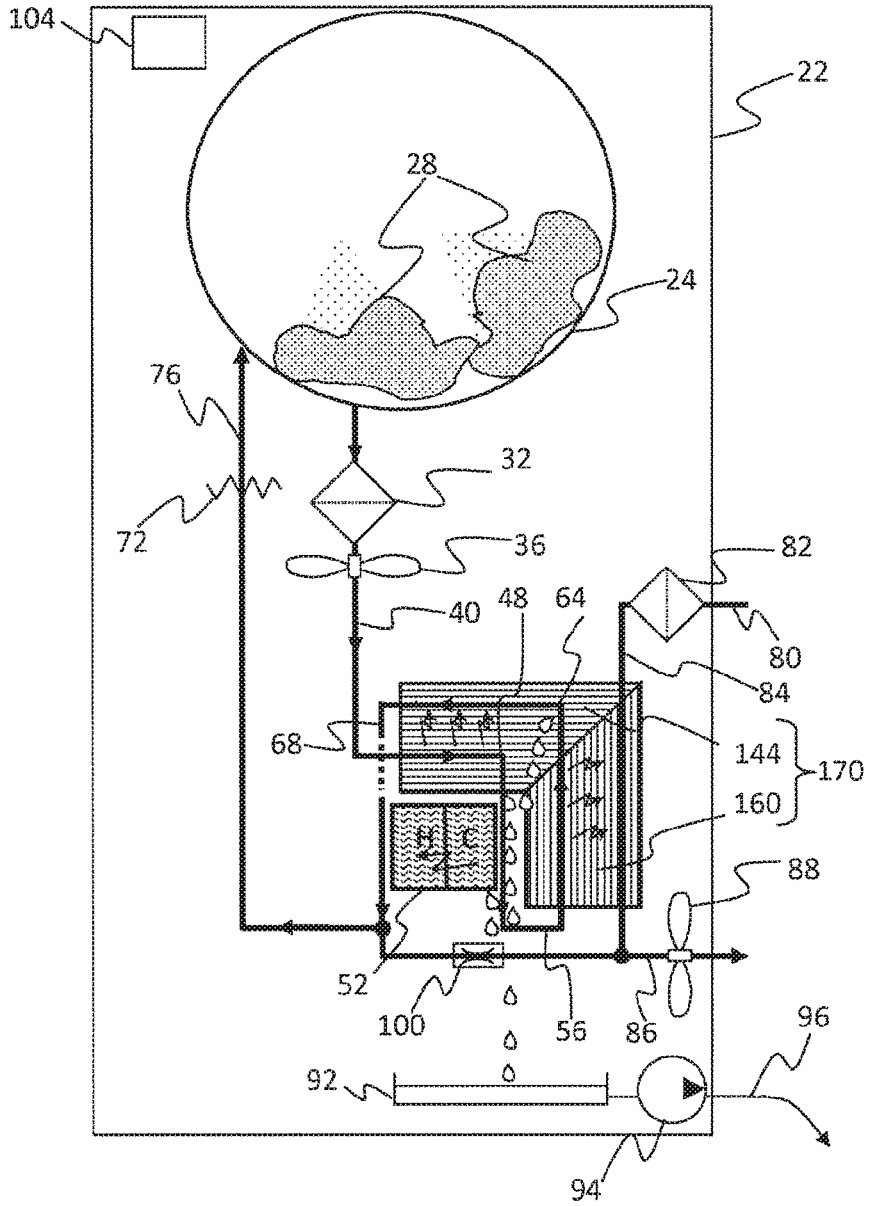

Condenser-based Dryer with Unified Regeneration Heat Exchanger and Cooling Heat Exchanger FIG. 2 is a block diagram that schematically illustrates a condenser-based laundry dryer 22, in accordance with another embodiment of the present invention. The general flow cycles and functionality of dryer 22 are the same as those of dryer 20 in FIG. 1. In the embodiment of FIG. 2, however, a unified heat exchanger assembly 170 comprises both a regeneration heat exchanger 144 and a cooling element 160 in a unified mechanical structure. Heat exchanger 144 carries out the functionality of heat exchanger 44 in FIG. 1. Heat exchanger 160 carries out the functionality of heat exchanger 60 in FIG. 1.

Heat-pump-based Dryer with Additional Heat Exchanger

Figure 3:
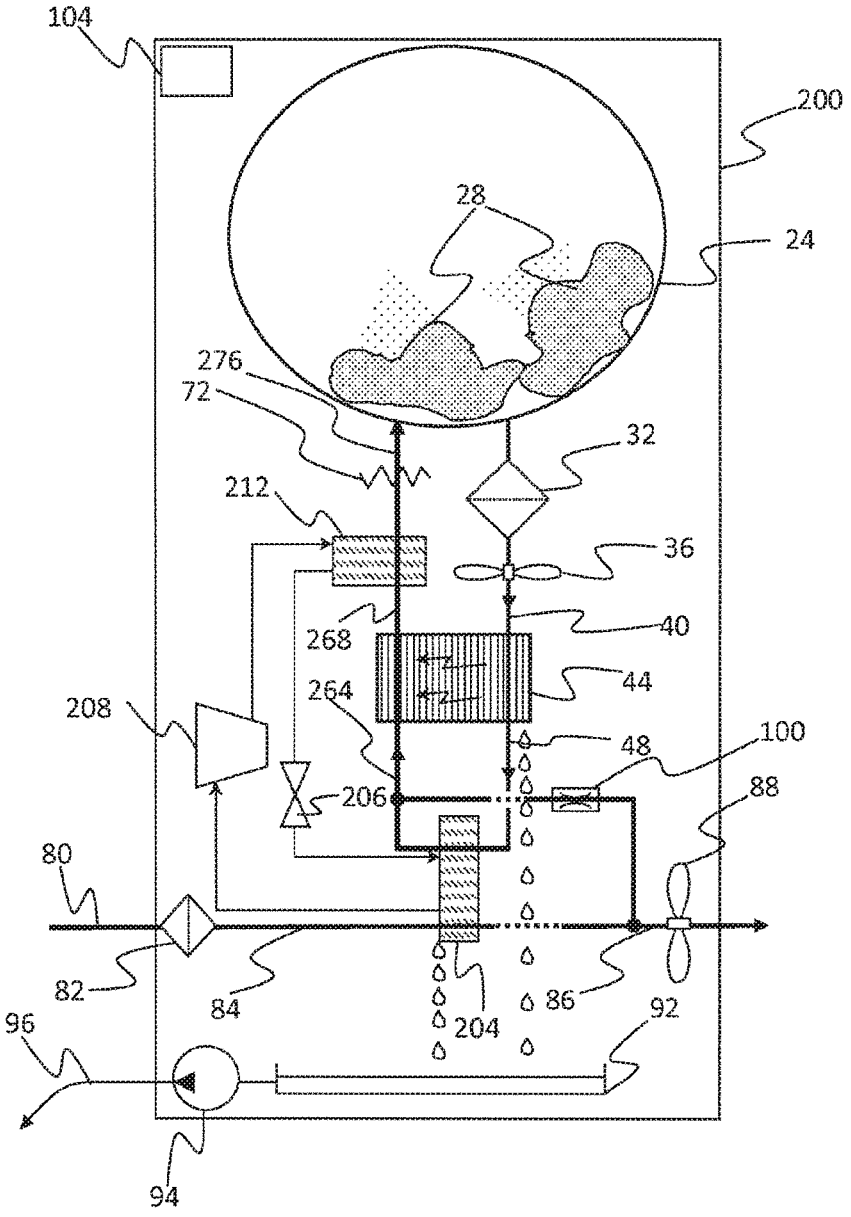
FIG. 3 is a block diagram that schematically illustrates a heat-pump-based laundry dryer, in accordance with an embodiment of the present invention.

FIG. 3 is a block diagram that schematically illustrates a refrigerant-based heat-pump laundry dryer 200, in accordance with yet another embodiment of the present invention. Dryer 200 comprises a heat pump having a refrigerant cycle, which cycles a refrigerant via a refrigerant evaporator 204, a compressor 208, a refrigerant condenser 212 and an expansion valve 206. Thus, in the present example refrigerant evaporator 204 serves as the cooling element, and refrigerant condenser 212 serves as a heating element.

Excess heat is removed from refrigerant evaporator 204 using external and filtered air 84, driven by blower 88. The air exits the system hotter than it enters, marked as 86. In some embodiments, refrigerant evaporator 204 can be split into two different refrigerant evaporators (not shown in the figure), one to be used as the cooling element of the closed cycle and one to be cooled by the external air stream.

Air 48 flows via cooling element 204, cools and condensates thereby producing more condensation water 92, and then exits the cooling element as air 264. Air 264 is cold, has high relative humidity but has low absolute humidity. Air 264 is heated by regeneration heat exchanger 44, and exits as air 268 that is hotter and dryer. Air 268 continues to flow through heating element 212, and may also be heated by electrical heater 72 to produce hot and dry air 276. To conclude the closed-loop process, air 276 is re-introduced into drum 24.

Figure 4:
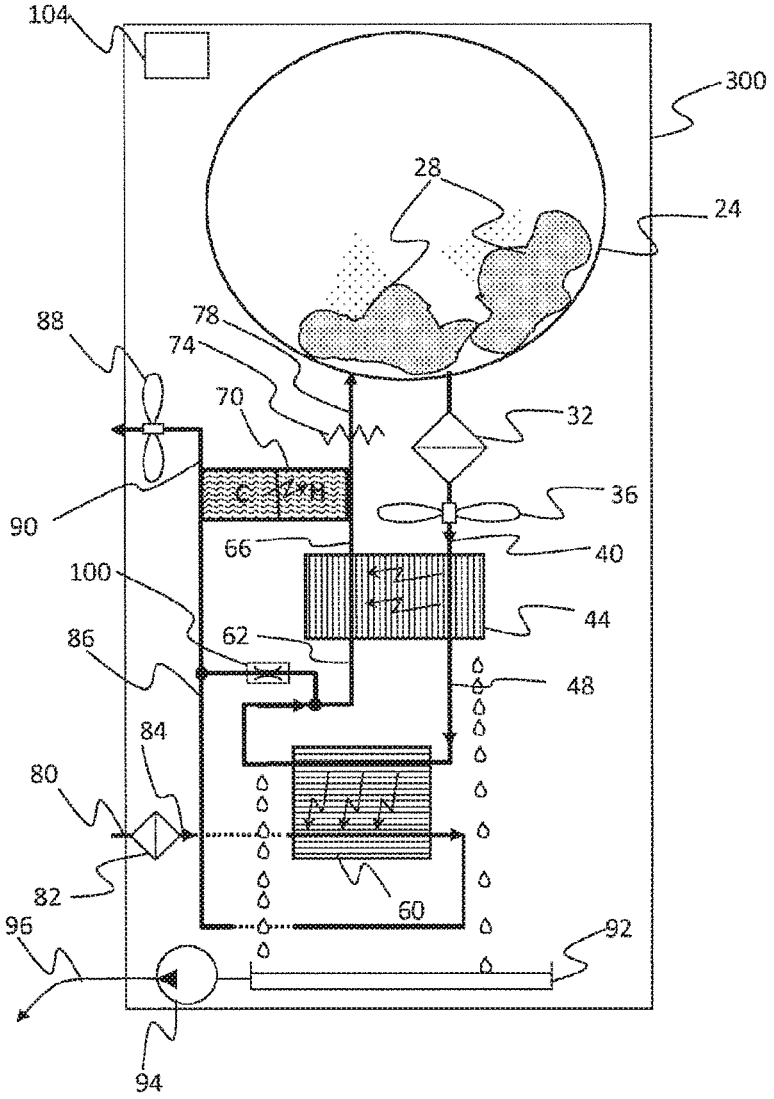
FIGS. 4-7 are block diagrams that schematically illustrate condenser-based laundry dryers, in accordance with alternative embodiments of the present invention.

Condenser-based Dryer with Regeneration Heat Exchanger, a Cooling Heat Exchanger and with Emitted Heat Reuse FIG. 4 is a block diagram that schematically illustrates a condenser-based laundry dryer 300, in accordance with yet embodiment of the present invention. In dryer 300, the heating element comprises the hot side of a TEC device 70 that uses the external-flow heat to heat the closed-cycle dry air flow entering the drum.

Air 48 enters heat exchanger 60, is cooled by heat transfer to air 84, and exists as air 62. Air 62 that exits heat exchanger 60 enters regeneration heat exchanger 44, is heated by heat transfer from air 40, and exits as air 66. The hot side of TEC device 70 heats air 66 using some of the heat of external air 86 that was previously heated in heat exchanger 60. The heating element may be also comprise a heater 74.

After passing some heat to the cold side of TEC 70, a blower 88 removes air 90 from dryer 300 to the external environment.

Figure 5:
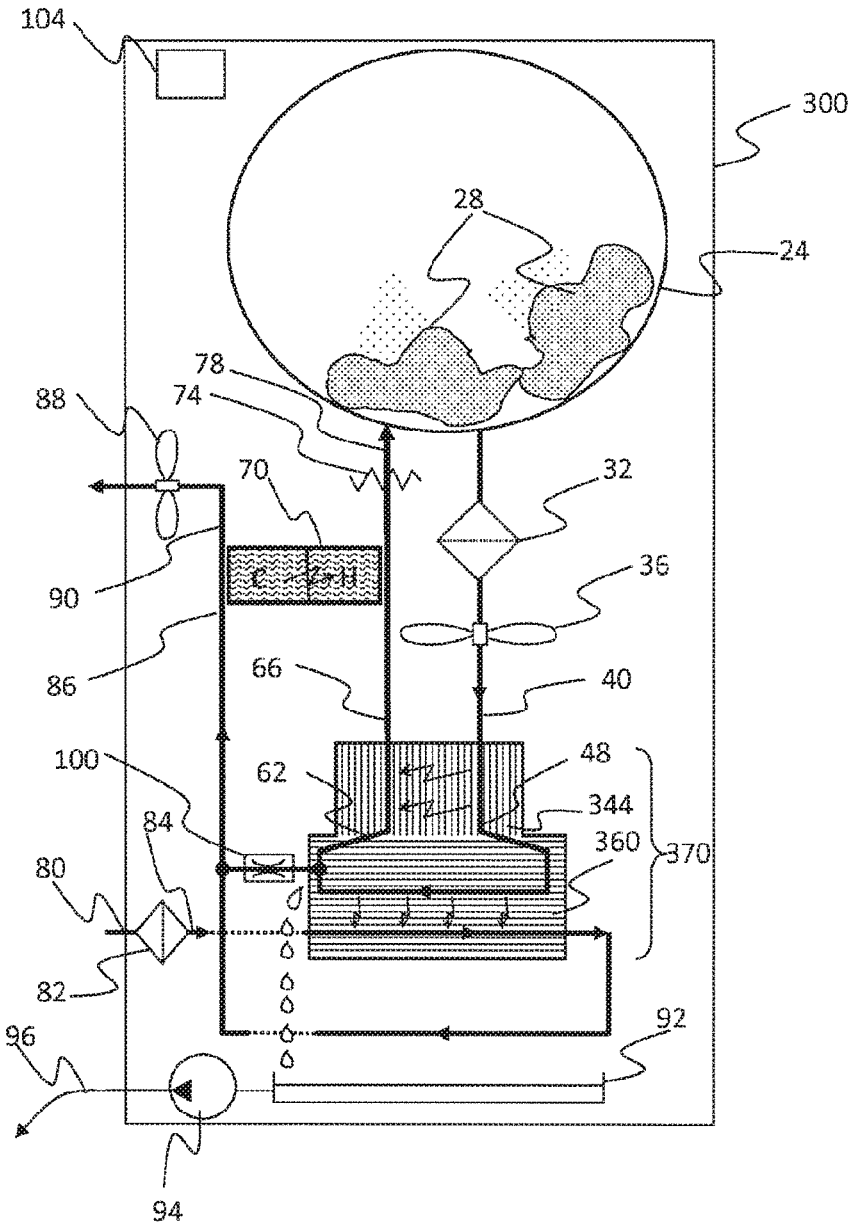
Figure 6:
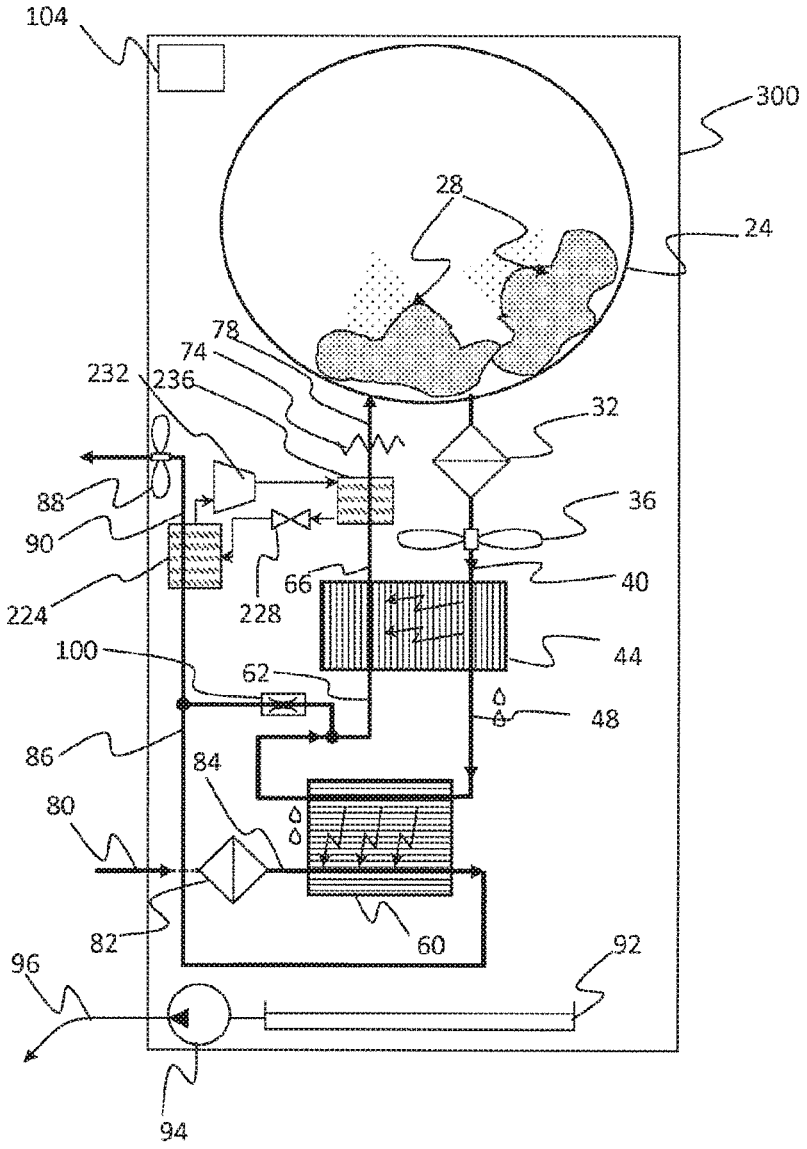
Figure 7:
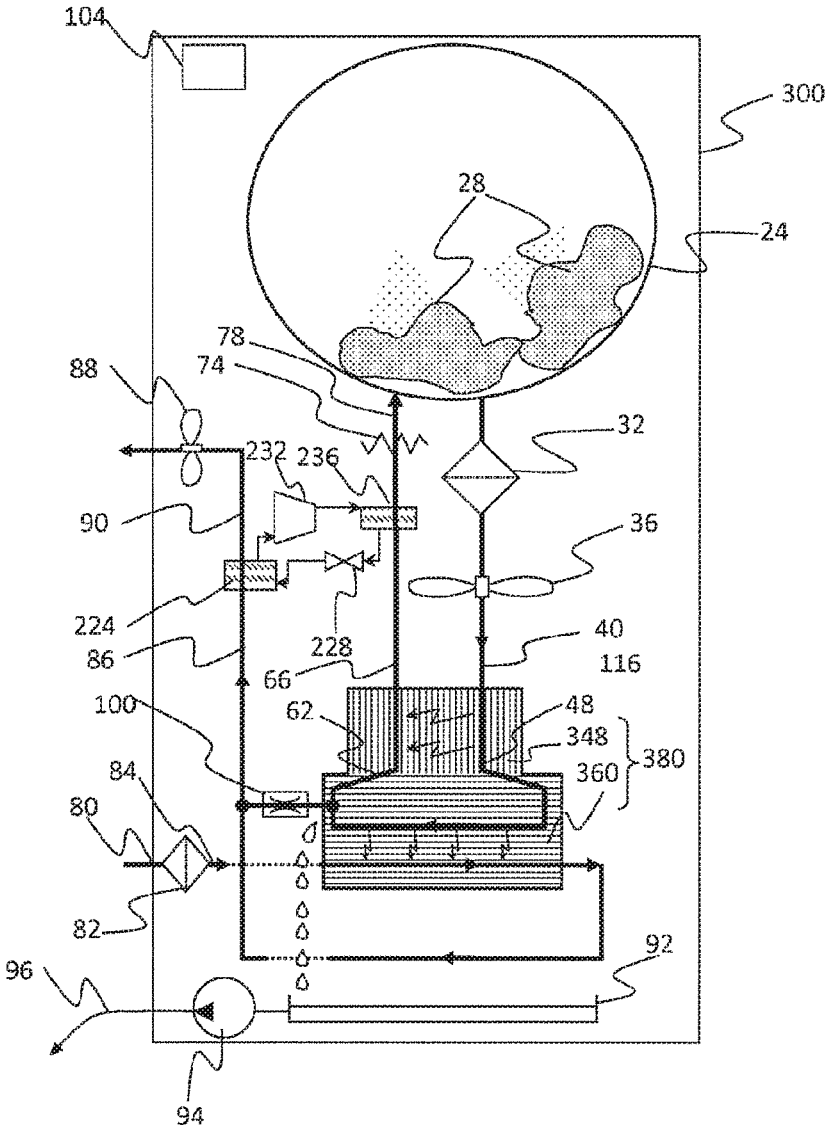

FIGS. 5-7 describe several possible variations of dryer 300 according to some embodiments of the present invention. The embodiment of FIG. 5 includes a unified heat exchanger 370 that comprises heat exchangers 344 and 360 in a single mechanical assembly. Heat exchanger 344 functions as heat exchanger 44 in FIG. 4, and heat exchanger 360 functions as heat exchanger 60 in FIG. 4. FIG. 6 includes a heat pump (comprising a refrigerant evaporator 224, a compressor 232, a refrigerant condenser 236 and an expansion valve 228) that replaces TEC 70 mentioned in FIG. 4. FIG. 7 is a combination of the variations described in both FIGS. 5 and 6: The heat pump replaces the TEC device and the heat exchangers are unified.

Dryer with Cooled-core Heat Exchanger

In some embodiments of the present invention, the cooling element comprises a cooled core that is mounted inside the heat exchanger. Dehumidification using a heat exchanger having a cooled core is addressed in U.S. Patent Application Publication No. 2014/0261764 and PCT International Patent Application Publication No. WO 2014/141059, cited above. These references also provide example mechanical configurations of such heat exchangers. Any of the configurations described in these references can be used in the closed-loop cycle of the dryers described herein.

Figure 8:
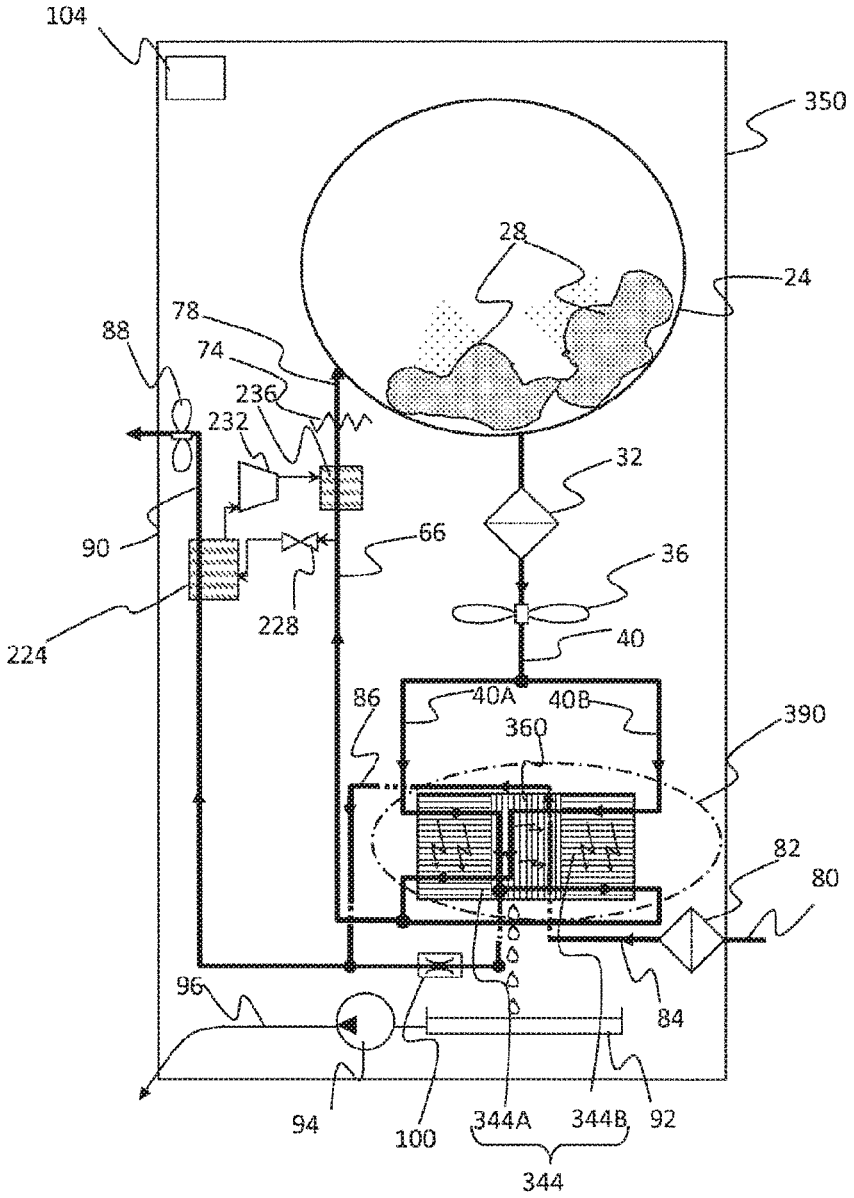
FIG. 8 is a block diagram that schematically illustrates a laundry dryer using a heat exchanger having a cooled core, in accordance with an embodiment of the present invention.
Figure 9:
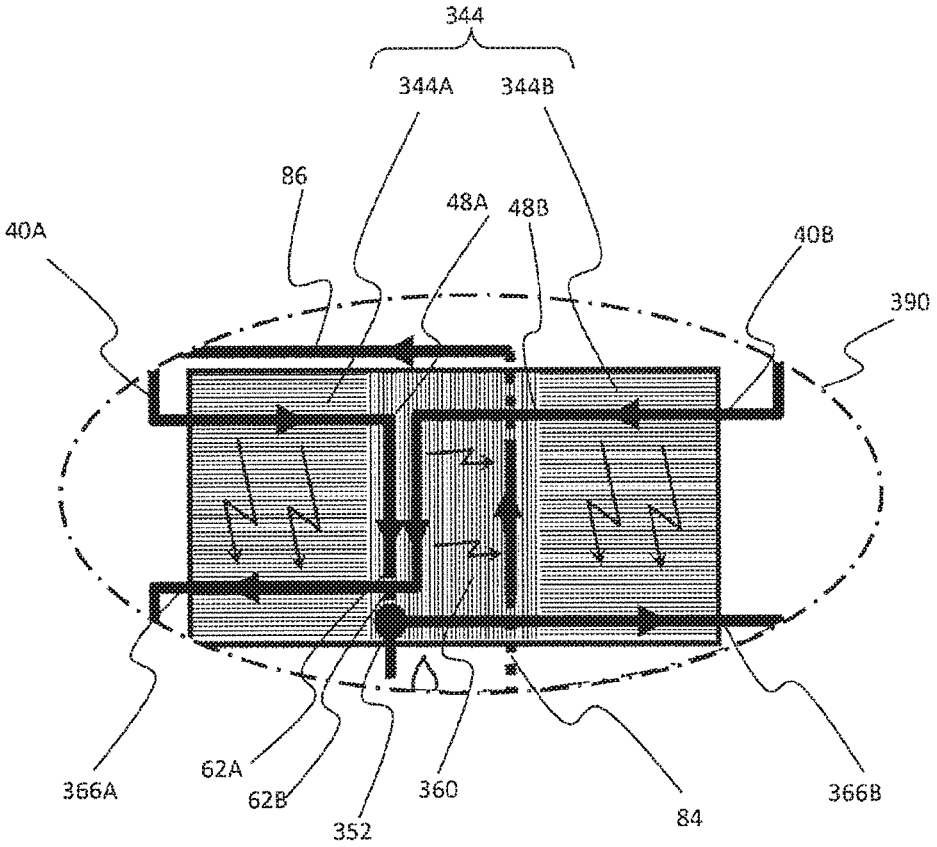
FIG. 9 is a block diagram that schematically illustrates a heat exchanger having a cooled core used in the laundry drier of FIG. 8, in accordance with an embodiment of the present invention.

FIGS. 8 and 9 are block diagrams that schematically illustrate a laundry dryer 350 using a heat exchanger having a cooled core, and details of this heat exchanger, in accordance with an embodiment of the present invention. In this embodiment, the dryer comprises an integrated cooling & heat exchange assembly 390. Assembly 390 uses external air 80 to cool a core 360 that is placed inside a heat exchanger 344. The air exiting the core is denoted 86. (In alternative embodiments, core 360 may be cooled using liquid, gas, refrigerant or any other suitable external fluid.) Cooled core 360 serves as the cooling element of the dryer.

Air 40, which was extracted from drum 24, is split into two flows denoted 40A and 40B. The two flows are applied to two respective inlets of heat exchanger 344, and flow across one another in alternating counter-flow pathways of the heat exchanger. Flow 40A is first cooled in heat exchanger 344A (before reaching core 360) by heat exchange with flow 62B that leaves the core. Similarly, flow 40B is first cooled in heat exchanger 344B (before reaching core 360) by heat exchange with flow 62A that leaves the core. The two flows are then cooled by flowing over core 360 against external air 84 that that absorbs the heat during this process.

External air 80, driven by blower 88 enters the dryer and being filtered by air filter 82 to remove dust and dirt. Filtered air 84 enters cooled core 360 as the cooling media. While flow 84 cools down flows 48A and 48B in the heat exchanger 360, flows 84A and 84B becomes hotter and exits heat exchanger 360 as flow 86, which is hotter than the environment and dry.

In other words, each of flows 40A and 40B undergoes three successive processes in assembly 390: Cooling in a first side of heat exchanger 344 by transferring the heat to the other flow that was already cooled by core 360; further cooling by flowing over core 360; and finally heating in the other side of heat exchanger 344 using the heat of the other flow that is entering the heat exchanger.

As a result of this joint operation (which is similar to the separate operations of cooling by condenser 60 and heat exchange by heat exchanger 44 of FIG. 4), air 62 exiting assembly 390 is considerably drier than air 40 entering assembly 390. The moisture extracted by assembly 360 condensates to produce condensate water 92.

In an embodiment, a junction 352 is connected to restrictor 100 (outside assembly 390). The restrictor 100 (e.g., a nozzle) enables releasing or adding small quantities of air from/to the closed-loop pathway as needed. Restrictor 100 performs a similar function to restrictor 100 of FIGS. 1-7 above.

As in previous embodiments, air 86 is heated and then re-introduced into drum 24. In the present example air 86 is heated by a heat pump (refrigerant evaporator 224, compressor 232, refrigerant condenser 236 and expansion valve 228) using the heat of the heated external air that is about to exit the dryer. Alternatively, heating can be performed by TEC 72, as explained above. Additionally or alternatively, air 86 can be heated by electrical heater 74 before re-entering drum 24.

In some embodiments of this invention, core 360 is cooled by external air 84, thereby producing warm air 86. (As noted above, the core may alternatively be cooled using any suitable liquid, gas, refrigerant or other suitable fluid.)

Figure 10:
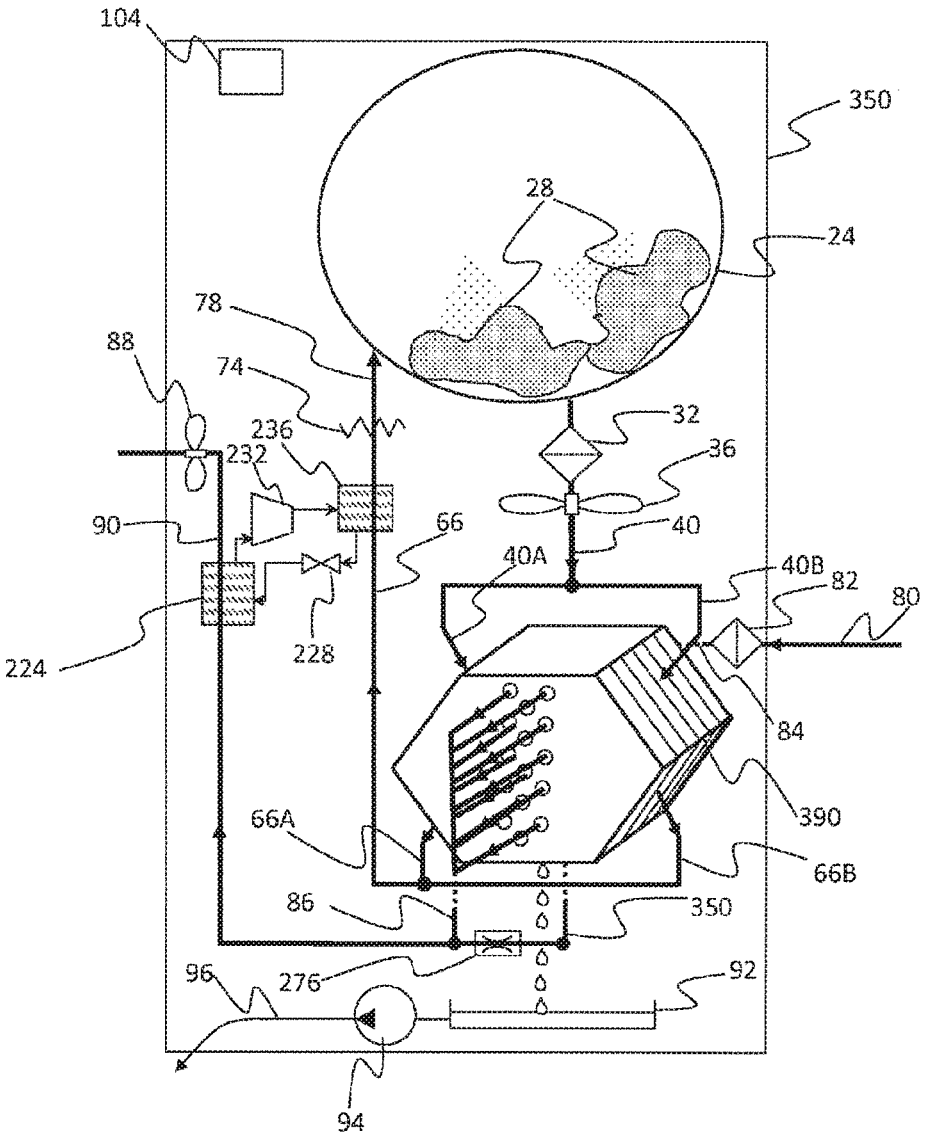
FIG. 10 is a block diagram that schematically illustrates the laundry dryer of FIG. 8, in accordance with an embodiment of the present invention.

FIG. 10 is a block diagram that schematically illustrates laundry dryer 350, in accordance with an embodiment of the present invention described in FIGS. 8 and 9. This figure shows an illustrative implementation example of assembly 390. Implementations of this sort are described, for example, in U.S. Patent Application Publication 2014/0261764, cited above.

As can be seen in the figure, air flows 40A and 40B enter assembly 390 via suitable pathways at the top of the assembly, and air flows 66A and 66B exit assembly 390 via suitable pathways at the bottom of the assembly. External air 84, for cooling core 360, enters from behind the assembly and air 86 exits the core at the front.

Multiple-drum Condenser Dryer with Multiple Regeneration Heat Exchangers

FIGS. 11-14 are block diagrams that schematically illustrate laundry dryers having multiple compartments, in accordance with embodiments of the present invention. In the disclosed configurations, a closed-loop air pathway traverses the multiple compartments (e.g., drums) in cascade. Each compartment is coupled to a respective regeneration heat exchanger, which exchanges heat between the air removed from the last compartment and the air entering the other compartments in the cascade. The closed-loop pathway typically comprises a single cooling element.

The examples below refer to three compartments, for the sake of clarity. Alternatively, however, the disclosed techniques can be used to implement multi-compartment dryers having any other suitable number of compartments.

Figure 11:
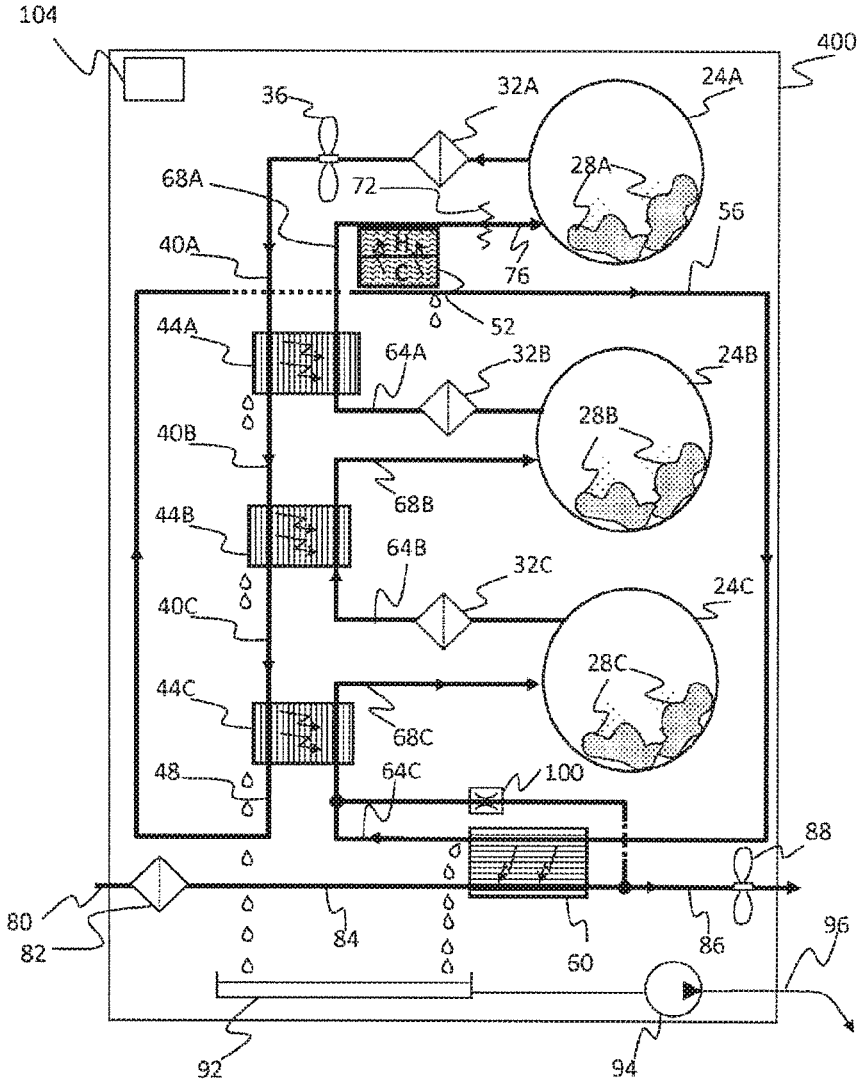
FIGS. 11-14 are block diagrams that schematically illustrate laundry dryers having multiple compartments, in accordance with embodiments of the present invention.

FIG. 11 is a block diagram that schematically illustrates a multi-drum laundry dryer 400, in accordance with an embodiment of the present invention. Dryer 400 has three drums 24A . . . 24C for drying laundry 28A . . . 28C, respectively. A closed-loop air pathway traverses the three drums in cascade: The air removed from a given drum is dried and heated, and then introduced into the next drum in the cascade. The last drum in the cascade, in the present example drum 24A, is the hottest of the three.

The heat of hot and humid air 40A, removed from the hottest drum is transferred using the respective regeneration heat exchangers into the air entering each drum. The air flow cascades from the outlet of one drum to the inlet of the next, i.e., from drum 24C toward drum 24B, and from drum 24B toward drum 24A. In this manner of connection, the energy required to dry the objects in all drums equals almost to the energy required to dry objects in a single drum. The heat energy is evacuated to the environment using cooling element 60 by exchanging heat to the external air flow.

In the example closed-loop pathway of FIG. 11, a blower 36 extracts hot and humid air 40A from drum 24A via a fiber filter 32A. Air 40A passes through a regeneration heat exchanger 44A. Air 40A exits heat exchanger 44A as air 40B, which is cooler and typically has higher relative humidity than air 40A entering the heat exchanger. Typically, condensation will occur in regeneration heat exchanger 44A, as air 40A cools, saturates, and continues to be cooled, thus producing condensate water 92.

Air 40B flows toward heat exchanger 44B for further cooling by heat exchanging. As air 40B continues to be cooled, thus producing more condensate water 92, it exits regeneration heat exchanger 44B as air 40C. Air 40C flows toward regeneration heat exchanger 44C for further cooling by heat exchanging. As air 40C continues to be cooled, thus producing more condensate water 92, it exits heat exchanger 44C as air 48.

In some embodiments, air 48 flows toward the cold side of a TEC device 52 for further cooling, and in order to reuse some of the condensation heat for the heating element. Air 48 exits the cold side of the TEC device as air 56.

Whether or not TEC device 52 is used, air 48 continues and becomes air 56 to be cooled using cooling element 60 by heat exchanging, thus producing more condensate water 92. The air exits the cooling element as air 64C and enters regeneration heat exchanger 44C. In heat exchanger 44C, air 64C is heated by heat exchanging and exits hotter and dryer as air 68C. Air 68C enters drum 24C to dry the objects within that drum.

The air exits drum 24C thru fiber filter 32C as air 64B, and enters regeneration heat exchanger 44B. In heat exchanger 44B, air 64B is heated by heat exchanging and exits hotter and dryer as air 68B. Air 68B enters drum 24B to dry the objects within that drum.

The air exits drum 24B thru fiber filter 32B as air 64A, and enters regeneration heat exchanger 44A. In heat exchanger 44A, air 64A is heated by heat exchanging and exits hotter and dryer as air 68A. Air 68A might be heated by the hot side of a TEC device 52 or/and other heating element, such as electrical heater 72. After heating, the air proceeds hotter and dryer as air 76 and enters drum 24A to dry the objects within that drum, to conclude the closed cycle operation. In the present example the air in the closed cycle is driven by blower 36, which can be located in any practical location in the closed cycle.

Blower 88 drives external air process to cool down the cooling element 60 by heat exchanging. External air 80 enters the dryer via a dust and dirt filter 82, proceeds as clean and relatively cold air 84 toward the cooling element 60, heats up in the cooling element by heat exchanging and exits hotter toward the environment.

Figure 12:
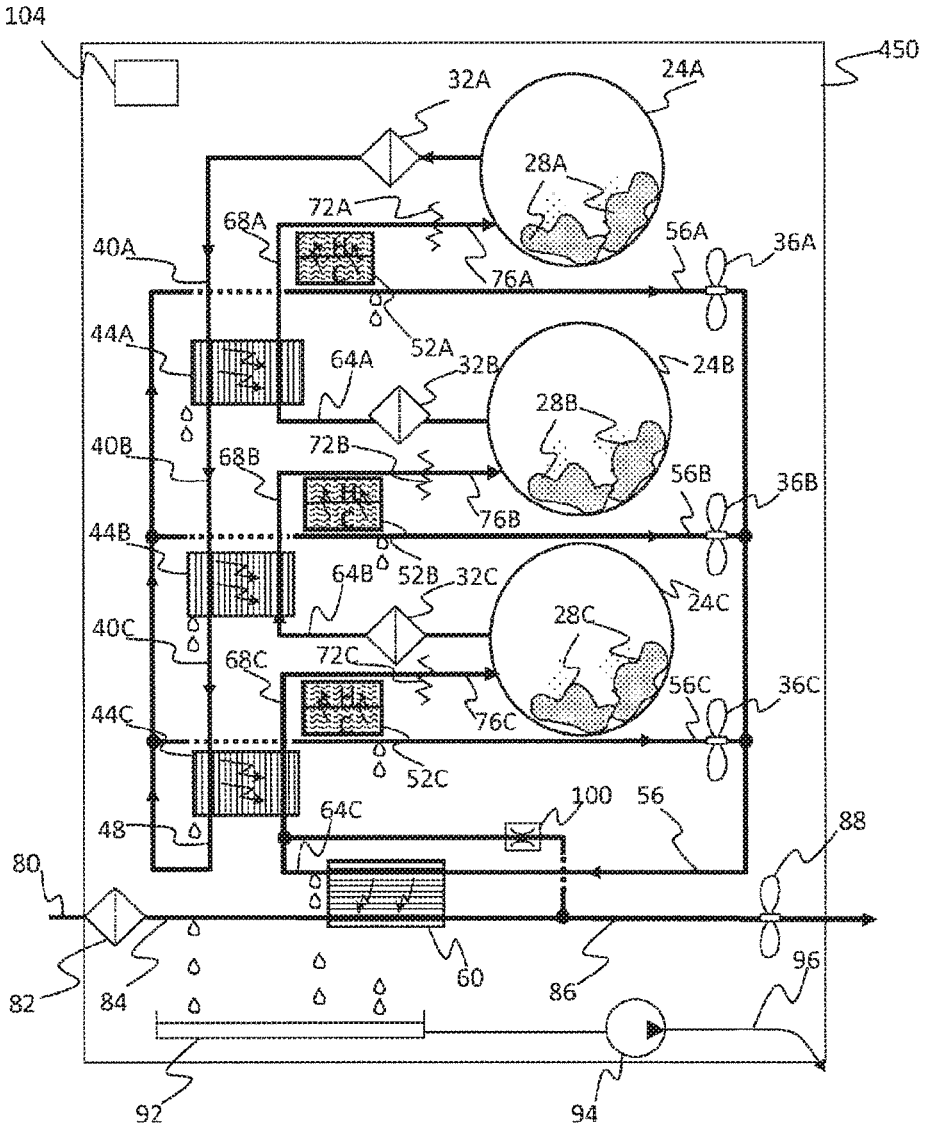

FIG. 12 is a block diagram that schematically illustrates a multi-drum laundry dryer 450, in accordance with another embodiment of the present invention. The functionality of dryer 450 is similar to the functionality of dryer 400 of FIG. 11, with several differences:

Drum 24A is not necessarily the hottest drum. The temperature relations among the drums can be setting the various heating elements (TECs and/or heaters).

Air flows 68A . . . 68C are heated by the hot sides of respective TEC devices 52A . . . 52C (and/or by electric heaters 72A . . . 72C) prior of entering drums 24A . . . 24C as air flows 76A . . . 76C, respectively.

Flow 48 in dryer 450 is split into three flows. The three flows are driven by separate respective blowers 36A . . . 36C. Alternatively, flow 48 can be driven by a single blower and be split by a distributor (not shown in the diagram).

The cold sides of TEC devices 52A . . . 52C cool flows 68A . . . 68C, respectively, typically producing more condensate water 92. The flows continue as flows 56A . . . 56C, respectively, and unite together to form flow 56.

Figure 13:
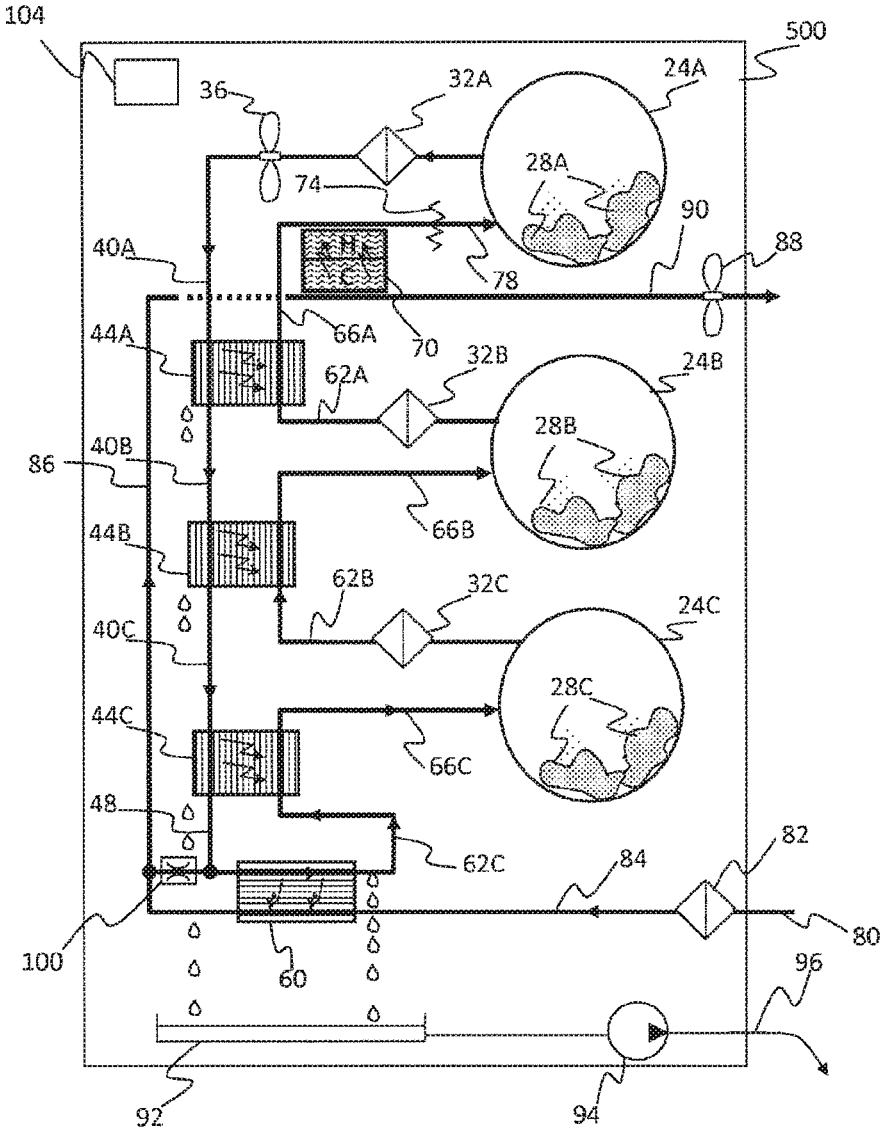

FIG. 13 is a block diagram that schematically illustrates a multi-drum laundry dryer 500, in accordance with yet another embodiment of the present invention. In the example closed-loop pathway of FIG. 13, a blower 36 extracts hot and humid air 40A from drum 24A via a fiber filter 32A. Air 40A passes through a regeneration heat exchanger 44A. Air 40A exits heat exchanger 44A as air 40B, which is cooler and typically has higher relative humidity than air 40A entering the heat exchanger. Typically, condensation will occur in regeneration heat exchanger 44A, as air 40A cools, saturates, and continues to be cooled, thus producing condensate water 92.

Air 40B flows toward heat exchanger 44B for further cooling by heat exchanging. As air 40B continues to be cooled, thus producing more condensate water 92, it exits regeneration heat exchanger 44B as air 40C. Air 40C flows toward regeneration heat exchanger 44C for further cooling by heat exchanging. As air 40C continues to be cooled, thus producing more condensate water 92, it exits heat exchanger 44C as air 48.

Air 48 enters heat exchanger 60, is cooled by heat transfer to air 84, and exists as air 62C. Air 62C that exits heat exchanger 60 enters regeneration heat exchanger 44C, is heated by heat transfer from air 40C, exits as air 66C, and enters drum 24C.

Air 62B exits drum 24C (after passing through filter 32C) enters regeneration heat exchanger 44B, is heated by heat transfer from air 40B, exits as air 66B, and enters drum 24B. Air 62A exits drum 24B (after passing through filter 32B) enters regeneration heat exchanger 44A, is heated by heat transfer from air 40A, and exits as air 66A.

The hot side of TEC device 70 heats air 66A using some of the heat of external air 86 that was previously heated in heat exchanger 60. The heating element may be also comprise a heater 74. To conclude the closed cycle, air 78 enters drum 24A. After passing some heat to the cold side of TEC 70, a blower 88 removes air 90 from dryer 500 to the external environment.

Figure 14:
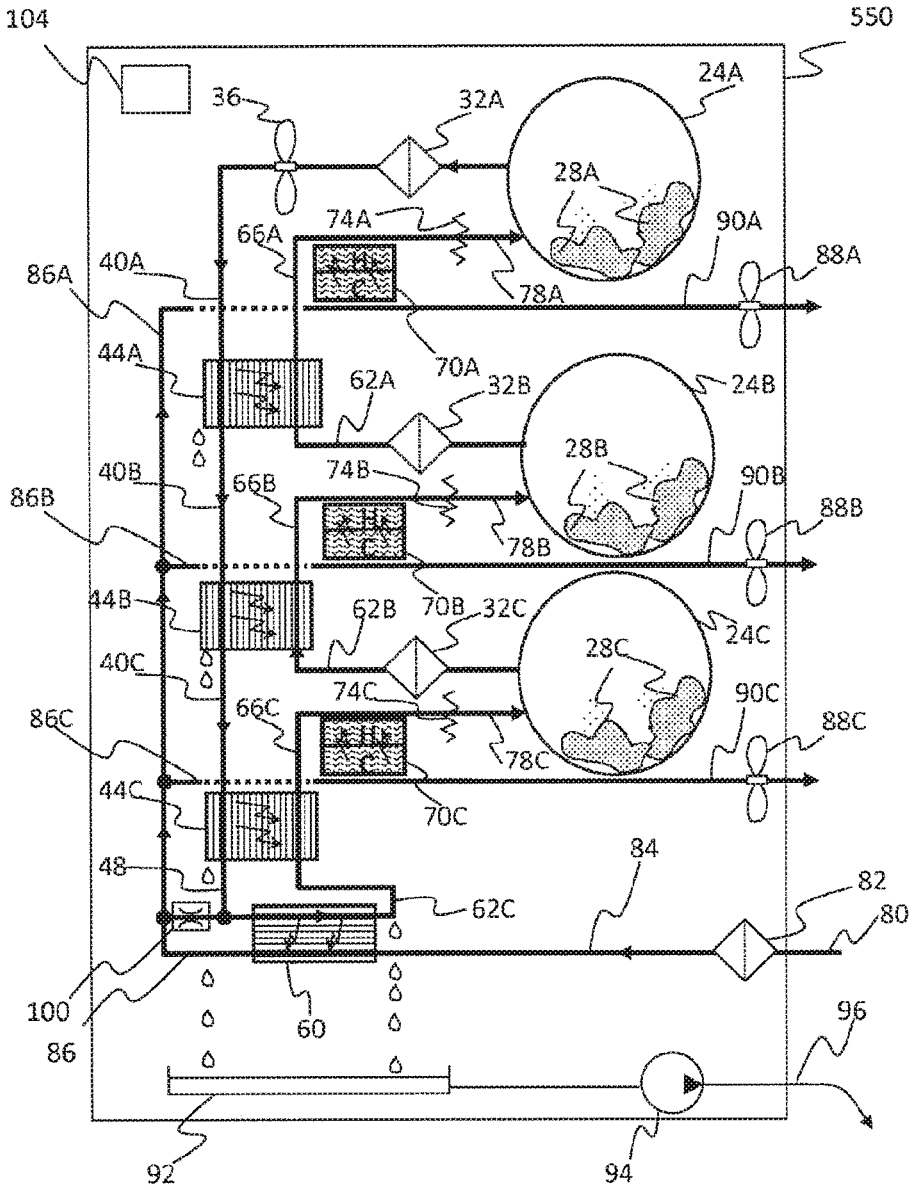

FIG. 14 is a block diagram that schematically illustrates a multi-drum laundry dryer 550, in accordance with another embodiment of the present invention. The functionality of dryer 550 is similar to the functionality of dryer 500, with several differences:

Drum 24A is not necessarily the hottest drum. The temperature relations among the drums can be setting the various heating elements (TECs and/or heaters).

Air flows 66A . . . 66C are heated by the hot sides of TEC devices 70A . . . 70C (and/or by electric heaters 78A . . . 78C) prior to entering drums 24A . . . 24C as air flows 78A . . . 78C, respectively.

Flow 86 in dryer 550 is split into 3 flows 86A . . . 86C. The three flows are driven by separate respective blowers 88A . . . 88C, respectively. Alternatively, flow 86 can be driven by a single blower before splitting.

The cold sides of TEC devices 70A . . . 70C cool flows 86A . . . 86C, respectively, typically producing more condensate water 92. The flows continue as flows 90A . . . 90C, respectively, and exit to the environment.

The multi-compartment dryer configurations of FIGS. 11-14 are depicted purely by way of example. In alternative embodiments, any other suitable dryer configuration, in which a closed-loop pathway cycles air in cascade through multiple drying compartments, can be used.

Figure 15:
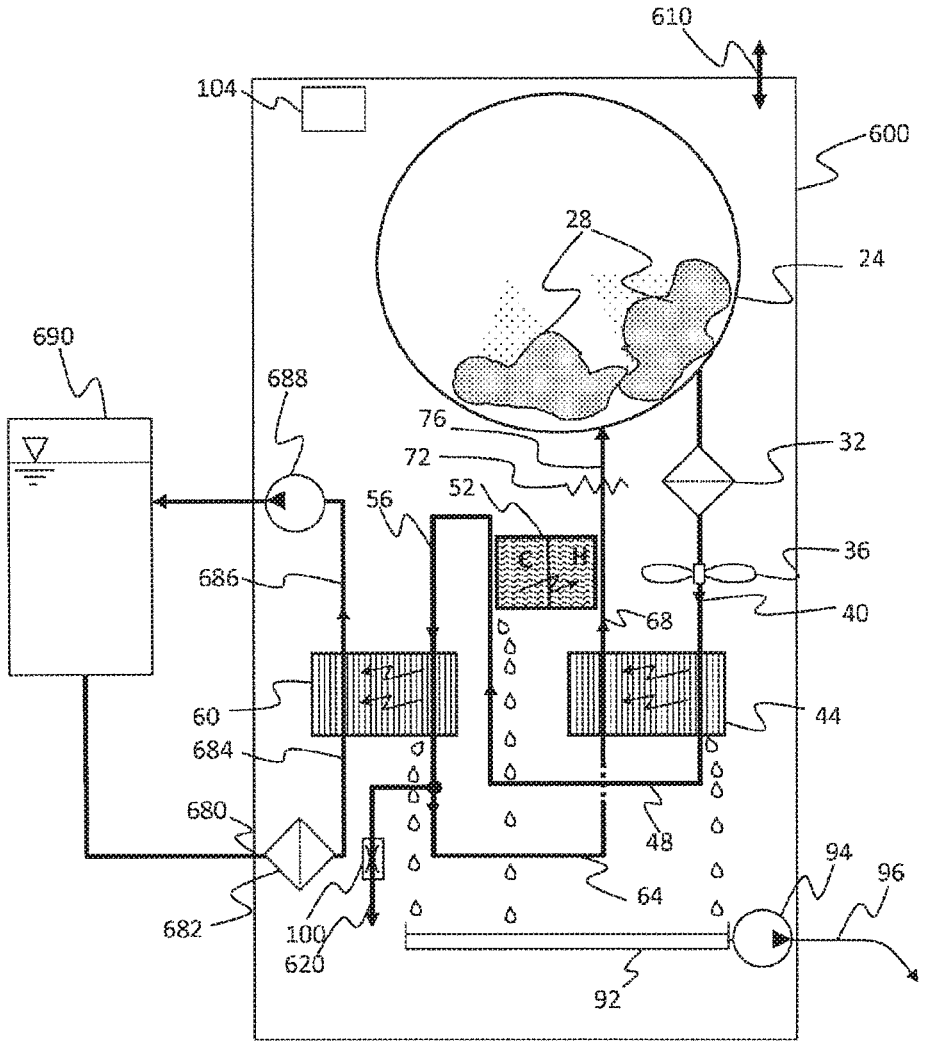
FIGS. 15 and 16 are block diagrams that schematically illustrate laundry dryers that export heat to an external system, in accordance with embodiments of the present invention.
Figure 16:
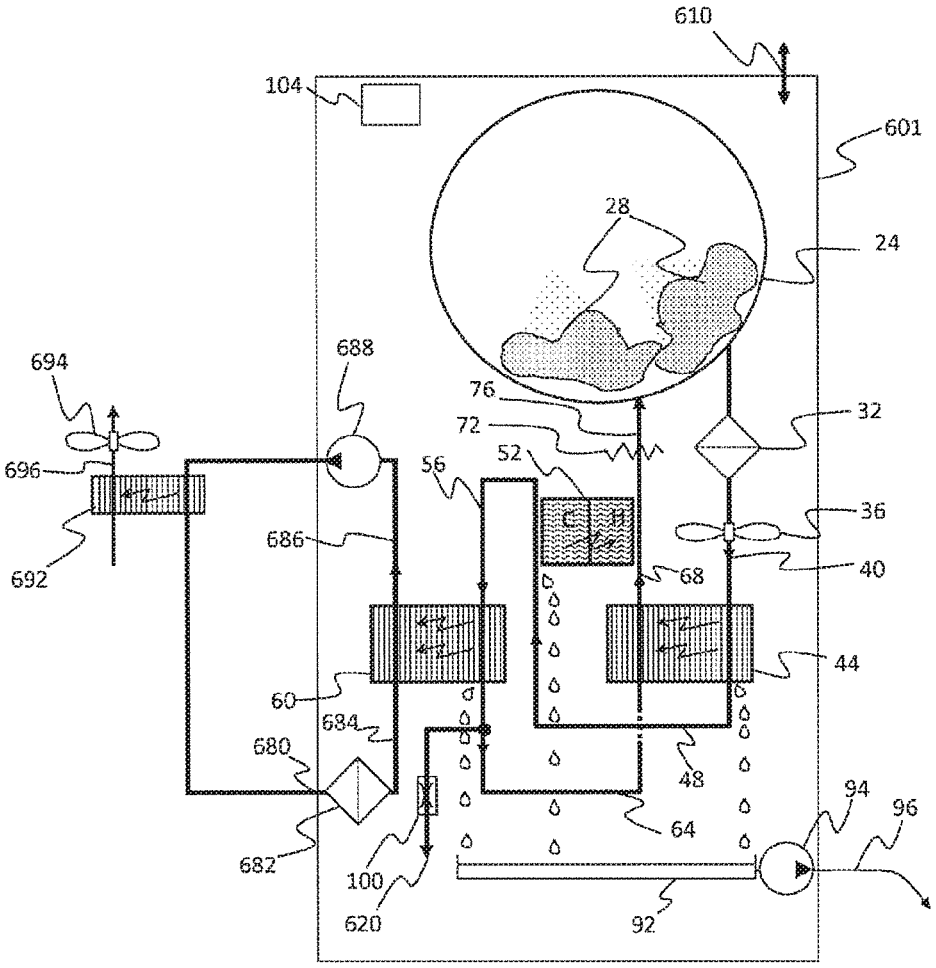

Condenser-based Dryer with Regeneration Heat Exchanger and Cooling Heat Exchanger with Emitted Heat Exploitation FIGS. 15 and 16 are block diagrams that schematically illustrate condenser-based laundry dryers 600 and 601 that reuse the heat emitted in the external process, in accordance with embodiments of the present invention. The emitted heat can be used, for example, for heating a water reservoir, a central air conditioning system, a sub-floor heating system, or for any other suitable purpose.

For simplicity, FIGS. 15 and 16 demonstrate the disclosed technique using the closed cycle of dryer 20, described in FIG. 1 above. Generally, however, the disclosed heat-reuse technique can be used with any of the other closed cycles shows in the figures above.

In FIG. 15, an additional pump 688 (replacing blower 88) is added to the dryer in order to circulate liquid, to cool down the cooling element 60 by heat exchanging. A reservoir 690 contains fluid, e.g., water, or other material. The fluid is cold in the beginning of the drying operation. The fluid entering the dryer (marked 680) passes through a dirt filter 682 and proceeds as flow 684 toward cooling element 60. The flow is heated by heat exchanging in cooling element 60 and emitted as flow 686, hotter than it was in the reservoir. It then enters the reservoir to rise up its temperature. During the drying process the emitted heat is kept within the reservoir. Alternatively to using water, the reservoir may comprise any other suitable material, such as Phase Change Material (PCM) or a material that stores heat using a chemical reaction.

An opening 610 in Dryer 600 enables exchanging a small amount of air between the environment and the inner side of the dryer enclosure. The inner side of the dryer enclosure is typically hotter than the environment due to heat losses from the drum, the heat exchangers and other elements.

In some embodiments, a restrictor 100 (e.g., a nozzle) bridges between the location where the air is driest and coolest, in the closed-loop pathway and between the inner volume of dryer enclosure, which is typically hotter than the environment. The restrictor enables small air volumetric changes in the closed loop cycle under various conditions. For example, when the closed-loop air volume expands (e.g., due to heating and/or water evaporation), the excess cold and dry air can be released from the closed cycle via the restrictor toward the inner enclosure volume, and from there via opening 610 toward the environment. As another example, when the closed-loop air volume contracts (e.g., due to cooling and/or water condensation), hot air from the inner enclosure volume can compensate for the contracted volume in the closed cycle. The inner enclosure volume is filled-up from the environment by the external air via opening 610.

Alternatively, pump 688 and/or filter 682 can be located outside dryer 600 as an add-on feature (not shown in the figure). In some embodiments, a combination of water circulation process as shown in FIG. 15 and external air process as shown in FIG. 1 can be used in order to cool down the cooling element (not shown in the figure).

A temperature sensor may be used as an input to controller 104, for example in order to choose the cooling media, to control the overheating of the reservoir, or for any other suitable purpose. One or more flow-control sensors may be used as input to controller 104, for example in order to monitor the flow rate and/or water level, or for any other suitable purpose.

FIG. 16 shows a dryer 601, which also exploits the emitted heat similarly to FIG. 15. In dryer 601, however, the circulated liquid heat is being evacuated instead of being accumulated in a reservoir. In the example of FIG. 16, an external heat exchanger 692 is used to drive the heat from flow 686 toward flow 696. Flow 696 is driven by blower 694. Air 696 can be taken from the house and/or from the environment, heated by heat exchanging in heat exchanger 692 and evacuated to the house and/or to the environment hotter than it entered.

In another embodiment, the heat evacuation from heat exchanger 692 is not performed by active flow of air 696, by blower 694. The heat might be transferred to sub-floor heating, radiator, or other suitable system. In some embodiments, fluid passes via the cooling element, in which it heats up by heat exchanging and proceeds hotter than it gets. The liquid can be kept within a reservoir or other means, and can originate from a reservoir or other source (not shown in the figure).

In cases where the external fluid has its own driving power, pump 688 is not mandatory. In cases where the external fluid is relatively clean, filter 682 may be omitted.

In some embodiments, the emitted heat can be reused internally in the dryer. For example, the emitted heat in flow 686 can be stored in some reservoir (e.g., using a suitable Phase-Change Material (PCM)), and later reused for heating the laundry in a subsequent drying cycle.

Condenser-based Dryer with Regeneration Heat Exchanger and Electric Generation

Figure 17:
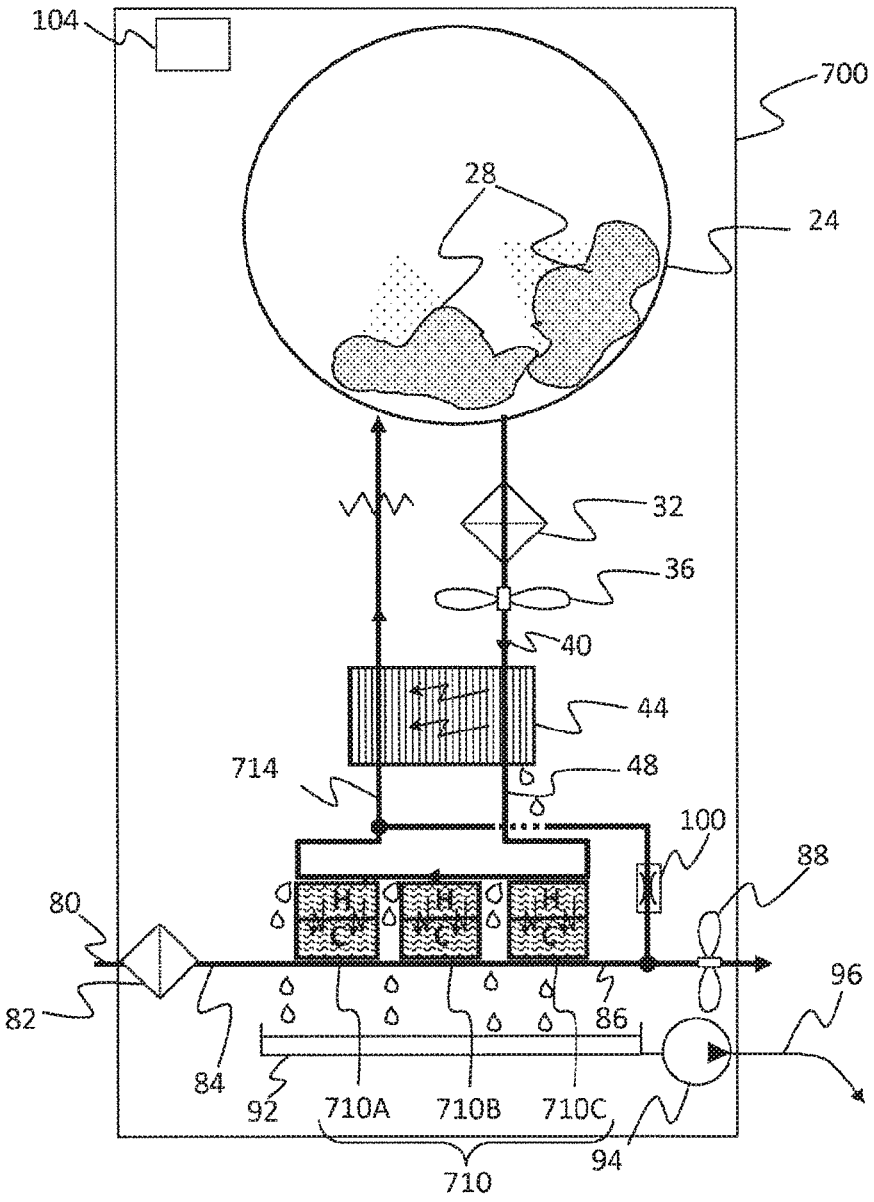
FIG. 17 is a block diagram that schematically illustrates a laundry dryer having a Thermo Electric Generator (TEG) serving as a cooling element, in accordance with an embodiment of the present invention.

FIG. 17 is a block diagram that schematically illustrates a condenser-based laundry dryer 700, in accordance with another embodiment of the present invention. In dryer, the cooling element of the closed-loop cycle is implemented using a heat generator, e.g., a Thermo Electric Generator (TEG) 710.

In the present example, TEG 710 comprises a cascade of multiple (e.g., three) TEG devices 710A . . . 710C. Multiple TEG devices typically achieve better performance than a single TEG device, although a single-TEG implementation is also feasible.

TEG 710 uses the temperature differential between flows 48 and 84 to produce electricity. During this process, flow 48 cools down and typically produces more condensate water 92, and air 48 leaves the hot side of the TEG devices hotter, as air 714. Air 84 becomes warmer due to the heat transferred by the TEG devices, and exits hotter as air 86. Air 714 enters heat exchanger 44, and flows against the hot and humid air 40 that was extracted from drum 24.

The example of FIG. 17 demonstrates the disclosed technique using a simplified closed cycle, for the sake of clarity. In alternative embodiments, a TEG-based cooling element can be used in any of the dryer configurations described above.

In some embodiments, the electrical energy harvested by TEG 710 can be fed back to some of the dryer devices, such as the heater or the blower. In alternative embodiments, the TEG device may be replaced by any other suitable type of heat harvesting device that converts heat into electricity.

The dryer configurations shown in FIGS. 1-17 are example configurations that are chosen purely for the sake of conceptual clarity. In alternative embodiments, any other suitable configuration that uses a closed-loop cycle having a regeneration heat exchanger and a cooling element can be used.

For example, any of the heat exchangers described in FIGS. 1-17 (e.g., heat exchangers 44, 44A-44C, 60, 170, 212, 204, 370, 224, 236, 370 and 390) may be implemented as a cross-flow heat exchanger, counter-flow heat exchanger, parallel-flow heat exchanger, or any other suitable heat exchanger type. Moreover, the functionality of the heat exchanger may be replaced by a TEC or a heat-pump.

In any of the closed-loop pathway configurations, reheating of air can be performed by a heater (e.g., heaters 72, 72A-72C, 74, 74A-74C), by the hot side of a TEC (e.g., TEC 52, 52A-52C, 70 and 70A-70C) or by the refrigerant condenser of a heat pump (e.g., refrigerant condenser 236 and refrigerant condenser 212).

In any of the closed-loop pathway configurations, the cooling element may comprise a heat exchanger that uses external fluid (e.g., heat exchanger 60, 360), by the cold side of a TEC (e.g., TEC 52, 52A-52C, 70 and 70A-70C), by the refrigerant evaporator of a heat pump (e.g., refrigerant condenser 204, 224), by the hot side of TEG (e.g. TEG 710,710A,710B,710C) or by the hot side of a heat harvesting device (e.g., Stirling engine, etc.).

In the examples of FIGS. 1-17, the blowers (e.g., blowers 36, 36A-36C, 88 and 88A-88C) are placed at specific locations in their respective pathways. These blower positions, however, are depicted only by way of example, and the blowers can alternatively be omitted or placed at any other suitable location along the air pathways.

Although the embodiments described herein mainly address laundry dryers, the methods and systems described herein can also be used in other applications that involve drying of various objects or materials, such as food, wood, paper and pulp drying, desiccant regenerating, alcohol distillation, paint drying, oil extraction and more.

Although the embodiments described herein refer mainly to drying of water, the disclosed techniques can be used for drying of alcohol, solvent, or other suitable materials. Although the embodiments described herein refer mainly to air that is circulated in the closed-loop pathway, the disclosed techniques can be used with other suitable gases being circulated.

In some embodiments, elements of the dryer (e.g., the compartment, tubing and/or heat exchangers) may be thermally insulated to reduce energy loss.

Although the embodiments described herein refer to condensation by heat exchange with external air (e.g., air 80), the disclosed techniques can be implemented by heat exchange with any other suitable external fluid, whether gas or liquid. For example, in one embodiment the external fluid may comprise tap water, in which case blower 88 may be replaced by a restrictor or controlled tap.

It will thus be appreciated that the embodiments described above are cited by way of example, and that the present invention is not limited to what has been particularly shown and described hereinabove. Rather, the scope of the present invention includes both combinations and sub-combinations of the various features described hereinabove, as well as variations and modifications thereof which would occur to persons skilled in the art upon reading the foregoing description and which are not disclosed in the prior art. Documents incorporated by reference in the present patent application are to be considered an integral part of the application except that to the extent any terms are defined in these incorporated documents in a manner that conflicts with the definitions made explicitly or implicitly in the present specification, only the definitions in the present specification should be considered.

The invention claimed is:

1. A drying apparatus, comprising:

a compartment for containing objects to be dried;

a closed-loop air pathway, which comprises a cooling element and a heating element, and which is configured to extract from the compartment air that includes moisture in the form of vapor, to evacuate heat energy from the extracted air to an external fluid flow by cooling using the cooling element so as to remove at least some of the moisture from the air, to reheat the air using the heating element, and to re-introduce the reheated air into the compartment; and a regeneration heat exchanger, which is inserted in the closed-loop air pathway and is configured to transfer heat from the air extracted from the compartment to the air exiting the cooling element in the air closed-loop pathway.

2. The drying apparatus according to claim 1, wherein at least one of the regeneration heat exchanger and the cooling element is fabricated at least partially from a material having low thermal-conductivity.

3. The drying apparatus according to claim 1, wherein at least one of the regeneration heat exchanger and the cooling element is fabricated at least partially from plastic.

4. The drying apparatus according to claim 1, wherein the regeneration heat exchanger and the cooling element are fabricated jointly in a single mechanical assembly.

5. The drying apparatus according to claim 1, wherein, by transferring the heat, the regeneration heat exchanger is configured to at least one of (i) cool the air extracted from the compartment thus producing condensate water therefrom, and (ii) heat the air exiting the cooling element.

6. The drying apparatus according to claim 1, wherein the cooling element comprises a cooling heat exchanger that is configured to cool the extracted air by heat exchange with the external fluid flow.

7. The drying apparatus according to claim 1, wherein the heating element is configured to heat the air before re-introduction into the compartment at least partially by transferring heat from another fluid flow.

8. The drying apparatus according to claim 7, wherein the other fluid flow comprises the air in the closed-loop air pathway prior to the cooling element.

9. The drying apparatus according to claim 7, wherein the other fluid flow comprises an external fluid flow exiting the cooling element.

10. The drying apparatus according to claim 1, wherein the cooling element is configured to cool the air at least partially by transferring heat to another fluid flow.

11. The drying apparatus according to claim 1, and comprising a restrictor for allowing volumetric expansion or contraction of the closed-loop air pathway.

12. The drying apparatus according to 11, wherein one side of the restrictor is connected to a location of driest and coolest air in the closed-loop air pathway.

13. The drying apparatus according to claim 11, wherein one side of the restrictor is connected to the external fluid flow heated by the cooling element.

14. The drying apparatus according to claim 11, and comprising an enclosure that packages the drying apparatus and is arranged to emit and absorb external air, wherein one side of the restrictor is configured to exchange air with the inner side of the enclosure.

15. The drying apparatus according to claim 1, wherein the cooling element is configured to convert at least some of the heat energy evacuated from the air of the closed-loop pathway into electricity.

16. The drying apparatus according to claim 1, and comprising an external fluid flow pathway, which is configured to exploit at least some of the heat energy added in the drying apparatus to the external fluid, by circulating the external fluid via an external system.

17. The drying apparatus according to claim 1, and comprising a fluid pathway, which is configured to exploit at least some of the heat energy emitted from the closed-loop air pathway by storing the heat energy in one or more heat reservoirs.

18. The drying apparatus according to claim 17, wherein the one or more heat reservoirs comprise at least one of a fluid, a Phase Changing Material (PCM) and a material that stores the heat energy by reacting chemically.

* * * * *